US008221556B2

(12) United States Patent
Sugaya

(10) Patent No.: US 8,221,556 B2
(45) Date of Patent: Jul. 17, 2012

(54) COPPER ALLOY PLUMBING HARDWARE, SUCH AS VALVES AND TUBE COUPLINGS, AND THE TREATMENT METHOD FOR REDUCING ELUTION OF LEAD

(75) Inventor: Norikazu Sugaya, Yamanashi (JP)

(73) Assignee: Kitz Corporation, Chiba (JP)

( * ) Notice: Subject to any disclaimer, the term of this patent is extended or adjusted under 35 U.S.C. 154(b) by 0 days.

(21) Appl. No.: 12/910,069

(22) Filed: Oct. 22, 2010

(65) Prior Publication Data

US 2011/0030738 A1 Feb. 10, 2011

Related U.S. Application Data

(60) Division of application No. 12/076,943, filed on Mar. 25, 2008, now abandoned, which is a continuation of application No. 10/526,742, filed as application No. PCT/JP2003/114983 on Sep. 9, 2003, now Pat. No. 7,368,019.

(30) Foreign Application Priority Data

Sep. 9, 2002 (JP) ..... 2002-262703
May 27, 2003 (JP) ..... 2003-149913

(51) Int. Cl.
*B08B 3/00* (2006.01)
*C23G 1/02* (2006.01)

(52) U.S. Cl. ..... 134/26; 134/3; 134/27; 134/28; 134/29; 134/40; 134/41

(58) Field of Classification Search ..... None
See application file for complete search history.

(56) References Cited

U.S. PATENT DOCUMENTS 5,034,066 A 7/1991 Imhof et al.
(Continued)

FOREIGN PATENT DOCUMENTS

EP 0 892 084 1/1999
(Continued)

OTHER PUBLICATIONS

English Machine Translation of JP 2000-017447A.*
(Continued)

*Primary Examiner* — Michael Kornakov
*Assistant Examiner* — Nicole Blan
(74) *Attorney, Agent, or Firm* — Wenderoth, Lind & Ponack, L.L.P.

(57) ABSTRACT

This invention relates to a plumbing device made of a copper alloy containing nickel salt, that includes a valve and a tube coupling having at least a liquid-contacting part washed with a cleaning fluid incorporating therein nitric acid and hydrochloric acid as an inhibitor under conditions of a temperature and a duration permitting effective removal of nickel salt, thereby performing nickel salt-removing treatment and causing the hydrochloric acid to form a coating film on the surface of the liquid-contacting part thereby effectively precluding elution of nickel salt from the surface of the liquid-contacting part in the presence of the coating film, wherein the nitric acid has a concentration c in a range of 0.5 wt %<c<7 wt % and the hydrochloric acid has a concentration d in a range of 0.05 wt %<d<0.7 wt % in the cleaning fluid, wherein the temperature is set to 10° C.≦x 50° C., and wherein nickel salt is removed with the cleaning fluid.

5 Claims, 16 Drawing Sheets

U.S. PATENT DOCUMENTS

| | | | | |
|---|---|---|---|---|
| 5,112,027 | A * | 5/1992 | Hanyu et al. | 251/331 |
| 5,544,859 | A | 8/1996 | Coltrinari et al. | |
| 5,601,658 | A | 2/1997 | Marinas et al. | |
| 5,904,783 | A | 5/1999 | Hager et al. | |
| 5,958,257 | A | 9/1999 | Regelbrugge et al. | |
| 6,007,408 | A * | 12/1999 | Sandhu | 451/41 |
| 6,013,382 | A | 1/2000 | Coltrinari et al. | |
| 6,197,210 | B1 | 3/2001 | Myerson | |
| 6,200,482 | B1 | 3/2001 | Winchester et al. | |
| 6,270,590 | B1 | 8/2001 | Giusti | |
| 6,293,336 | B1 | 9/2001 | Emerick, Sr. et al. | |
| 6,383,643 | B1 | 5/2002 | De Jarlais | |
| 6,434,967 | B2 | 8/2002 | Emerick, Sr. et al. | |
| 6,461,534 | B2 | 10/2002 | Giusti | |
| 6,770,215 | B2 | 8/2004 | Giusti | |
| 2001/0045272 | A1 | 11/2001 | Emerick, Sr. et al. | |
| 2002/0043308 | A1 | 4/2002 | Giusti | |
| 2002/0189721 | A1 | 12/2002 | Giusti | |
| 2004/0053466 | A1 * | 3/2004 | Mikawa et al. | 438/253 |
| 2007/0166473 | A1 | 7/2007 | Sugaya et al. | |

FOREIGN PATENT DOCUMENTS

| | | |
|---|---|---|
| JP | 2000-017447 | 1/2000 |
| JP | 2000017447 A * | 1/2000 |
| JP | 2002-155391 | 5/2002 |

OTHER PUBLICATIONS

International Search Report mailed Dec. 24, 2003 in International (PCT) Application No. PCT/JP03/11493.

* cited by examiner

FIG.2
(a) Way of setting to avoid formation of an air pocket
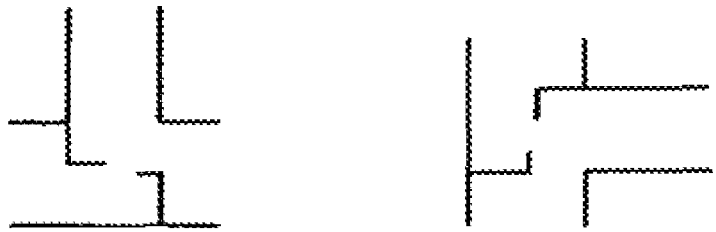
(b) Way of setting to suffer formation of an air pocket
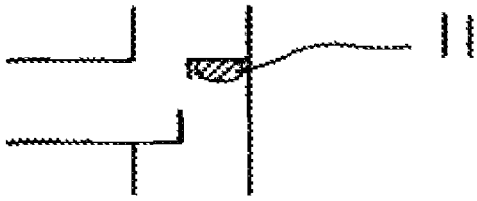

Relation between duration of treatment and temperature of treatment

FIG.18

| | Step 1 | Step 2 | Step 3 | Step 4 | Surface treatment | | | | | Step 10 |
|---|---|---|---|---|---|---|---|---|---|---|
| | | | | | Step 5 | Step 6 | Step 7 | Step 8 | Step 9 | |
| Seat surface metal touch valve | Casting | Chemical polishing | Cold water washing | Machining | Degreasing | Cold water washing | Acid pickling | Cold water washing | Rust preventing | Nickel chromium plating |

| | Step 1 | Step 2 | Step 3 | Step 4 | Surface treatment | | | Step 8 | Step 9 |
|---|---|---|---|---|---|---|---|---|---|
| | | | | | Step 5 | Step 6 | Step 7 | | |
| Elbow and seat surface soft seat valve | Casting | Machining | Chemical Polishing | Cold water washing | Acid pickling | Cold water washing | Rust preventing | Nickel chromium plating | |
| Faucet | Casting | Machining | Chemical Polishing | Cold water washing | Acid pickling | Cold water washing | Rust preventing | Buffing of outer surface | Chromium plating |
| Decompression valve | Casting | Machining | Chemical Polishing | Cold water washing | Acid pickling | Cold water washing | Rust preventing | Nickel chromium plating | |
| Water meter | Casting | Machining | Chemical Polishing | Cold water washing | Acid pickling | Cold water washing | Rust preventing | Nickel chromium plating | |

COPPER ALLOY PLUMBING HARDWARE, SUCH AS VALVES AND TUBE COUPLINGS, AND THE TREATMENT METHOD FOR REDUCING ELUTION OF LEAD

This application is a Divisional of U.S. application Ser. No. 12/076,943, filed Mar. 25, 2008, now abandoned, which is a Continuation of U.S. application Ser. No. 10/526,742, filed Mar. 7, 2005, now U.S. Pat. No. 7,368,019, which is a national stage application of International Application No. PCT/JP03/11493, filed Sep. 9, 2003.

TECHNICAL FIELD

This invention relates to a copper alloy plumbing hardware, such as valves, tube couplings and water taps which are plated with a nickel alloy, and the copper alloy plumbing hardware; and further to a treatment method for reducing elution of lead. More particularly, this invention relates to a copper alloy plumbing hardware, such as valves and tube couplings and the treatment method for reducing elution of lead, by acid-pickling feed water valves, water and hot water supply valves, tube couplings, strainers and other such plumbing hardware, which are made of lead-containing copper alloys, such as bronze and brass, thereby preventing them from eluting lead into a fluid, such as tap water, to which they are exposed and enabling them to satisfy the standard regarding the elution of lead or by acid-pickling water and hot water supply valves, tubes, couplings, water taps, pipes and other such plumbing hardware, which are plated with a nickel alloy, thereby preventing them from eluting nickel into a fluid, such as tap water, to which they are exposed and enabling them to satisfy the guideline regarding the elution of nickel and, as well, realizing a treatment for efficiently (in terms of temperature of treatment, duration of treatment, etc.) precluding elution of both or either of lead and nickel and, in addition thereto, performing a treatment for neutralizing the varying fluid used for the treatment of precluding the elution of both or either of lead and nickel and rendering it usable as industrial water, a copper alloy plumbing hardware, such as valves and tube couplings and the treatment method for reducing elution of lead,

BACKGROUND ART

Generally, to the pipeline for water supply and hot water supply, valves, tube couplings, strainers, or other such plumbing hardware are connected. Most of these items of plumbing hardware are made of copper alloys, such as bronze and brass, which excel in castability, machinability and economy.

Particularly, the valves and couplings made of bronze and brass use these alloys in a form having lead (Pb) added thereto in prescribed amounts with a view to enhancing castability and machinability in the case of bronze and cuttableness and hot forgeability in the case of brass.

When the fluid, such as the tap water, is supplied to the valve which is made of bronze or brass containing lead, it is inferred that the part of lead of the lead-containing metal precipitated to the surface layer of the part of the valve exposed to the fluid is eluted into the tap water.

Heretofore, the tap water used for drinking has been required to conform to the standard of water quality regarding elution of lead that is examined and rated by a specific method.

Since lead is a harmful substance to the human body, the amount of its elution must be decreased to the fullest possible extent. Recently, the regulation regarding the standard of water quality with respect to the elution of lead from the plumbing hardware, such as a valve, has been directed toward further rigidification.

In the circumstance, the development of plumbing hardware, such as a valve, that satisfies the requirement has been yearned for. Thus, various methods for precluding the elution of lead as by the treatment of acid pickling or the treatment of alkali pickling have been proposed.

As a means to preclude the elution of lead by the treatment of acid-pickling which has been reduced to practice, a technique which, as disclosed in Japanese Patent No. 3345569, comprises rinsing at least the liquid-contacting part of plumbing hardware made of a lead-containing copper alloy with a cleaning fluid composed of nitric acid and hydrochloric acid incorporated additionally as an inhibitor and consequently causing the hydrochloric acid to form a coat on the surface of the liquid-contacting part and deleading the surface layer of the liquid-contacting part has been known, for example.

Then, as a means to preclude the elution of lead by the treatment of alkali pickling which has been reduced to practice, a technique which, as disclosed in the Japanese Patent No. 3182765, comprises immersing a lead-containing copper alloy in an alkaline etching liquid incorporating additionally an oxidizing agent therein, thereby selectively dissolving and removing the lead on the surface of the lead-containing copper alloy material has been known, for example.

The method of Japanese Patent No. 3182765, however, entails the problem of incurring loss of thermal energy during the treatment because the series of steps of treatment entail frequent changes of temperature.

The Japanese Patent No. 3182765 further discloses a technique that comprises continuously plating the outer surface of a lead-containing copper alloy material while giving the inner surface thereof a treatment for allaying the elution of lead at the same time.

Items of plumbing hardware, such as a valve, a tube coupling and a water tap, undergo various plating treatments including nickel plating with the object of having the appearance of the outer surface, the resistance to corrosion and the wear resistance thereof improved. When the fluid, such as the tap water, is supplied to the plumbing hardware, it will have the possibility of inducing the plumbing hardware to elute the nickel component. This nickel, on entering the human body, entails the problem of inducing diseases, such as allergy, though it has low oral toxicity because it is hardly absorbed in the intestine. Thus, the desirability of developing plumbing hardware that satisfies the upper limit of tolerance of nickel elution (0.02 mg/l or 0.01 mg/l) proposed in the amendment to the WHO drinking water guideline or in the guideline on the items of management being studied by Ministry of Welfare and Labor has been finding growing recognition.

Further, the desirability of perfecting a technique which, by realizing efficient reclamation of the varying fluid used in the treatment for precluding lead elution instead of directly discarding it as a waste liquor, permits a generous cut of cost and ensures due observance of the influence on the environment has been finding enthusiastic approval.

This invention has been perfected as a result of a diligent study performed in due respect of the true state of affairs mentioned above. This invention is aimed at providing a technique which greatly decreases the amount of lead elution as compared with the conventional standard in the use of the plumbing hardware which is made of a lead-containing metal, and further, in the plumbing hardware having a surface plated with nickel, precludes elution of the nickel by infallibly removing the nickel adhering to the inner surface of the plumbing hardware, further realizes a treatment for efficient (treating temperature, treating duration, etc.) preclusion of both or either of lead and nickel, and performs a neutralizing treatment on the varying fluid used in the treatment for precluding elution, thereby rendering the fluid usable as industrial water, permitting a generous cut in cost and allowing thorough observance of the influence on the environment.

DISCLOSURE OF THE INVENTION

To attain the above objects, the present invention provides a plumbing device made of a copper alloy containing nickel salt, that includes a valve and a tube coupling having at least a liquid-contacting part washed with a cleaning fluid incorporating therein nitric acid and hydrochloric acid as an inhibitor under conditions of a temperature and a duration permitting effective removal of nickel salt, thereby performing nickel salt-removing treatment and causing the hydrochloric acid to form a coating film on the surface of the liquid-contacting part thereby effectively precluding elution of nickel salt from the surface of the liquid-contacting part in the presence of the coating film, wherein the nitric acid has a concentration c in a range of 0.5 wt %<c<7 wt % and the hydrochloric acid has a concentration d in a range of 0.05 wt %<d<0.7 wt % in the cleaning fluid, wherein the temperature is west to 10° C.≦x 50° C., and wherein nickel salt is removed with the cleaning fluid.

The present invention further provides a plumbing device, comprising component parts forged, or forged and subsequently machined, individually subjected to a nickel salt-removing treatment, wherein the treated component parts are assembled into a finished product.

The present invention further provides a plumbing device, further comprising a plurality of parts cast, or cast and subsequently machined, and subjected to a nickel salt-removing treatment.

The present invention further provides a plumbing device, wherein the copper alloy treated by a nickel salt-removing treatment is brass or bronze.

The present invention further provides a plumbing device, wherein the brass is a material proofed against elution of zinc.

The present invention further provides a plumbing device, wherein a plumbing device has a surface thereof plated with a nickel-containing alloy.

The present invention also provides a treatment method for reducing elution of lead from a plumbing device that is made of a copper alloy, contains lead and has a liquid-contacting part, including a valve and a tube coupling, comprising the step of subjecting at least the liquid-contacting part to chemical polishing treatment, thereby removing lead existing as segregated on a surface layer of the liquid-contacting part.

The present invention further provides a treatment method, further comprising the step of subjecting the surface layer having the lead removed to acid-pickling or alkali-pickling treatment to effectively delead the surface layer.

The present invention further provides a treatment method, further comprising the steps of subjecting the surface layer having the lead removed to acid-pickling or alkali-pickling treatment to effectively delead the surface layer and subjecting the deleaded surface layer to plating treatment for lead elution reduction.

The present invention further provides a treatment method, wherein the chemical polishing treatment is performed for 10 or more seconds.

In the treatment method just mentioned above, the plumbing device is a valve having a structure having a valve seat part sealed in metal touch and further comprising the steps of casting the valve before the chemical polishing treatment and subjecting the valve to surface roughness-increasing treatment after the chemical polishing treatment.

In the treatment method just mentioned above, the plumbing device is made of bronze or brass.

BRIEF DESCRIPTION OF THE DRAWINGS

FIG. 2(*a*) is an explanatory diagram illustrating modes of avoiding formation of an air pocket in a workpiece and FIG. 2(*b*) an explanatory diagram illustrating a mode of allowing formation of an air pocket in a workpiece.

FIG. 18 is an explanatory process diagram illustrating one example of a method of precluding lead elution by performing a treatment of chemical abrasion prior to a rinsing treatment.

BEST MODE FOR CARRYING OUT THE INVENTION

One embodiment for applying a method of the present invention for precluding lead elution to a valve made of lead-containing bronze or brass will be described with reference to the drawings annexed hereto.

Figure 1:
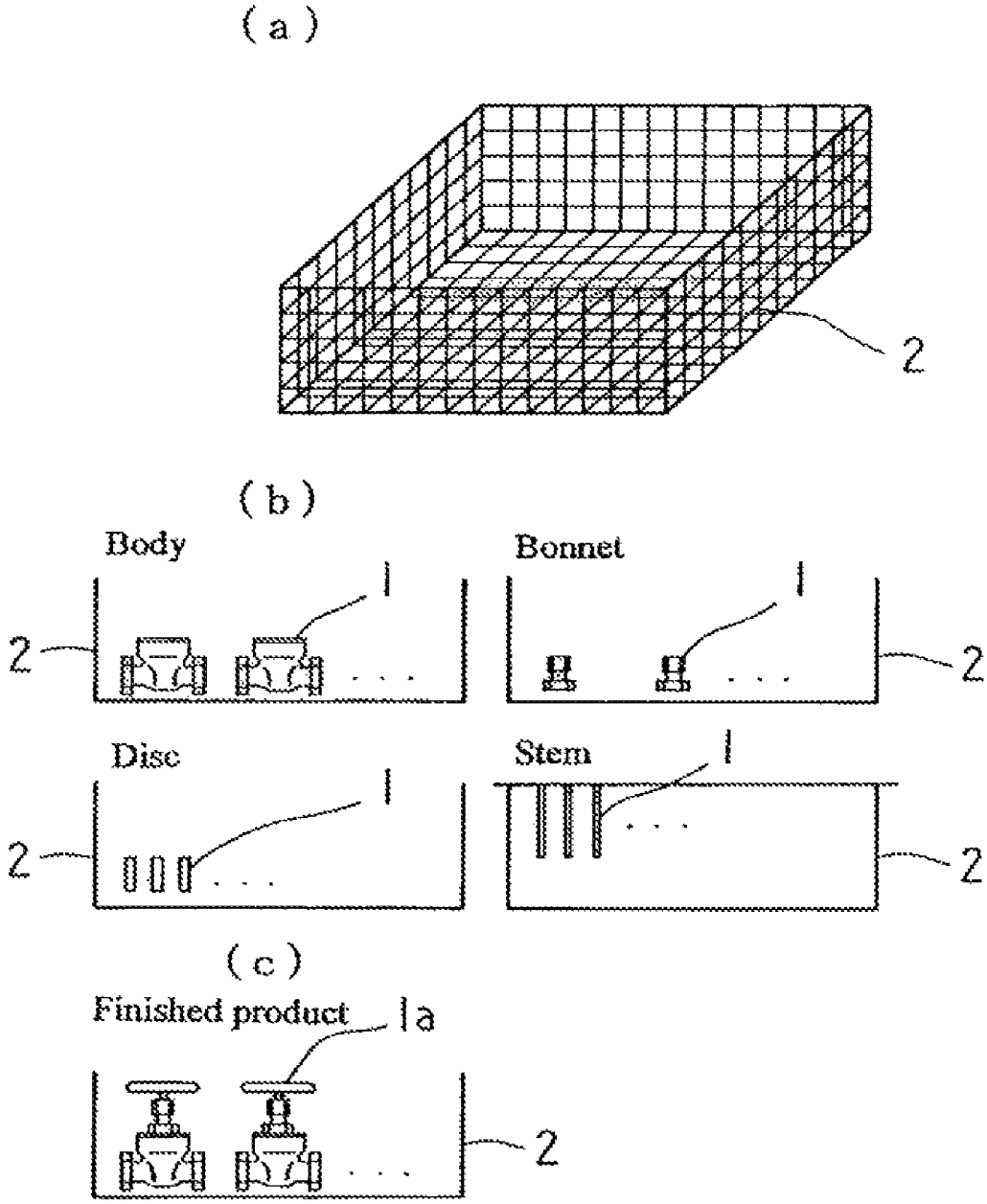
FIG. 1(*a*) is a perspective view illustrating a specially designed container, FIG. 1(*b*) an explanatory diagram illustrating cast and then machined valve parts disposed in such special containers, and FIG. 1(*c*) an explanatory diagram illustrating valves (completed products) each formed of a plurality of parts disposed in such a special container.

Valve parts (or couplings, tap parts, etc.) 1 which have been cast and then machined are so arranged inside a specially designed reticular container 2 resistant to heat and chemicals as to avoid colliding with and inflicting marks and scratches on one another during the course of conveyance as illustrated in FIG. 1. During the arrangement, it is proper for the workpieces to be disposed so that the air bubbles occurring therein may be expelled upwardly or laterally lest they should stagnate therein and give rise to air pockets 11. One example of the way of arranging them is illustrated in FIG. 2.

Since the valves have a complicated shape, all the liquid-contacting portions of the valve parts 1 are enabled during the immersion in the treating vessel to contact the cleaning fluid by imparting a vibration or a supersonic stimulation to the valve parts, thereby removing thoroughly the air bubbles remaining in a small amount therein.

Figure 3:
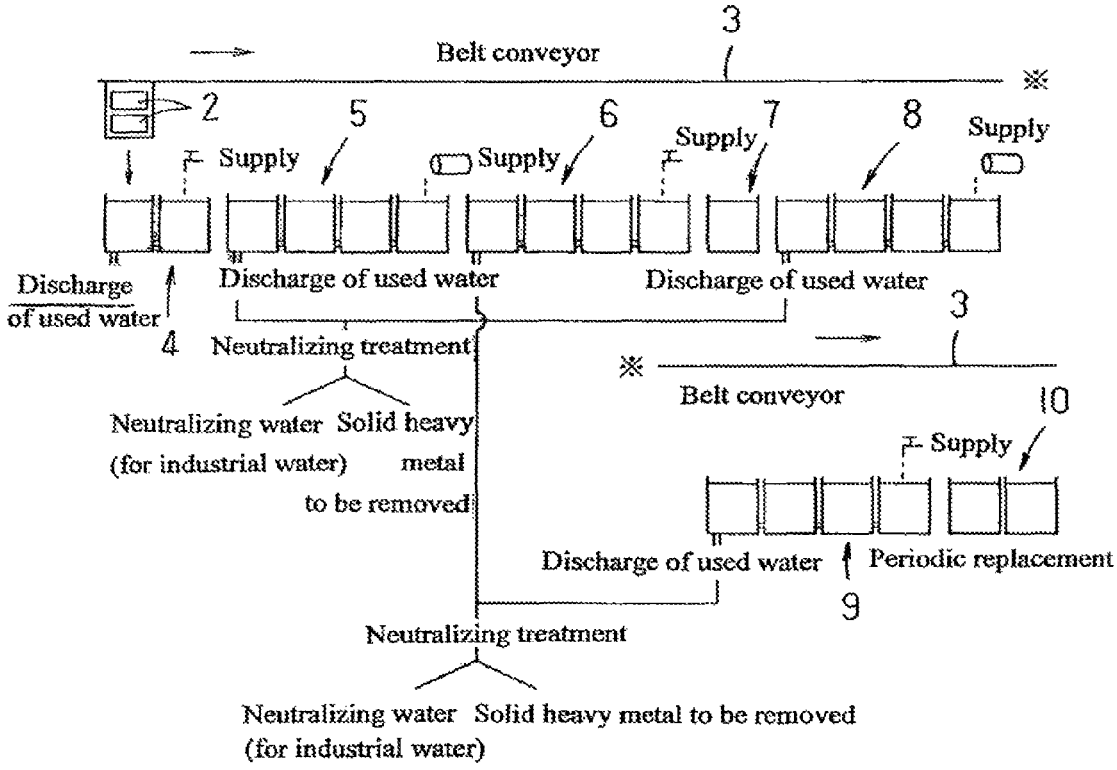
FIG. 3 is a block diagram illustrating a process for performing a treatment for precluding elution of lead in accordance with this invention.

All the steps of the process that will be specifically described herein below and as shown in FIG. 3 are performed on the valve parts 1 that are set fast in the specially designed container 2 mentioned above. After undergoing the process, the valve parts 1 are withdrawn from the specially designed container 2 and advanced to the assembling process. The present embodiment adopts a belt conveyor 3 as a means to convey the valve parts to the individual steps of the process. Alternatively, the valve parts may be given acid pickling in the form of finished products (valves in the present embodiment) each composed of a plurality of valve parts that have been cast and then machined.

The amounts of lead eluted from the CAC406 products when they were in an untreated form, when they were cast, washed and machined (by a cutting operation), and when they were cast, then machined (by a cutting operation) and washed are shown in Table 1. These amounts of lead elution were corrected values obtained of a given sample installed halfway along the length of a piping and operated as a plumbing utensil in accordance with the provision of HS S3200-7 "Method for testing a plumbing utensil for property of elution." The samples used for the test were bronze (made of CAC406) 10K screw valves having a nominal diameter of ½B according to JIS B2011. The washing treatment using 4 wt % of nitric acid+0.4 wt % of hydrochloric acid was performed at a temperature of 25° C. for a duration of 10 minutes, with all the samples wholly immersed in the washing fluid.

TABLE 1

Results of test of CAC406 products for lead elution

| Condition of treatment | Amount of lead elution (mg/l) |
|---|---|
| Untreated product | 0.04 |
| Product cast, washed and machined | 0.017 |
| Product cast, machined and washed | 0.003 |

The amounts of lead eluted from the C3771 products when they were in an untreated form, when they were cast, washed and machined (by a cutting operation), and when they were cast, then machined (by a cutting operation) and washed are shown in Table 2. These amounts of lead elution were corrected values obtained of a given sample installed halfway along the length of a piping and operated as a plumbing utensil in accordance with the provision of JIS S3200-7 "Method for testing a plumbing utensil for property of elution." The samples used for the test were bronze valves (made of CAC406) with 10K screw type gate valves having a nominal diameter of ½B according to JIS B2011. The cleaning treatment was performed under the same conditions as the CAC406 products mentioned above.

TABLE 2

Results of test of C3771 products for lead elution

| Condition of treatment | Amount of lead elution (mg/l) |
|---|---|
| Untreated product | 0.02 |
| Product cast, washed and machined | 0.012 |
| Product cast, machined and washed | 0.003 |

It has been confirmed, as shown in Table 1 and Table 2, that the CAC406 products and the C3771 products that were cast, then machined and washed produced the least amounts of lead elution.

Besides the fact that the machining work allows advance removal of the lead segregated to the surface of a plumbing device, the machined surface is enabled to suppress the elution of lead because it acquires a small surface area per unit region as compared with the surface of cast skin or the forged surface and constitutes a decreased liquid-contact portion. By performing the washing treatment of this invention after the cutting work, it is made possible to suppress the elution of lead efficiently.

The component steps of the method for precluding the elution of lead according to this invention will be described below.

Figure 4:
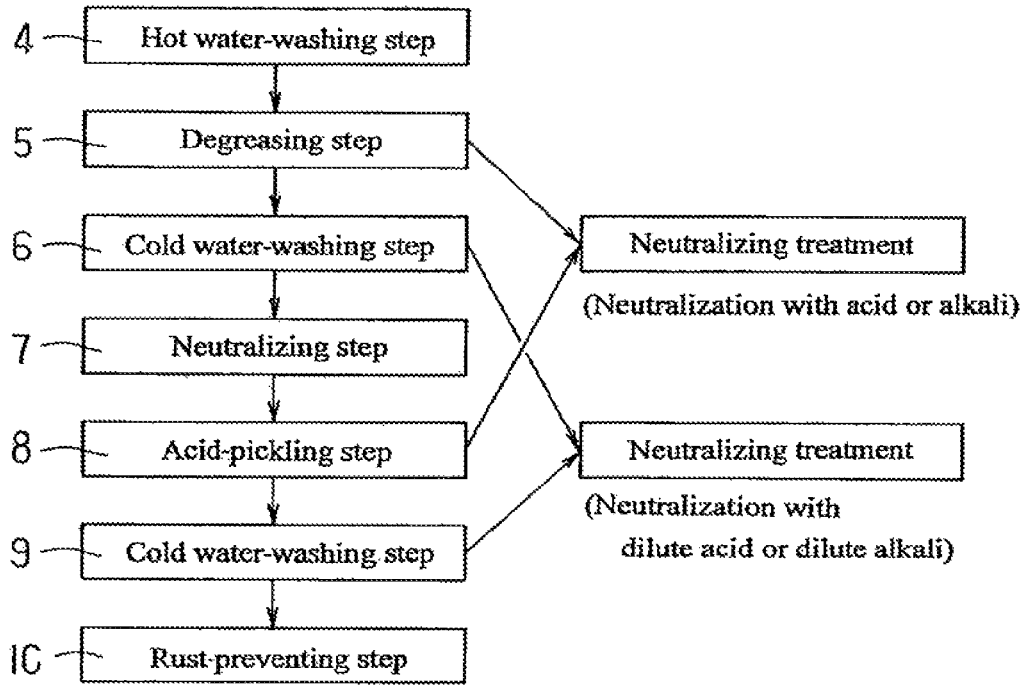
FIG. 4 is a flow chart illustrating one example of a process for performing a treatment for precluding elution of lead in accordance with this invention.

FIG. 4 is a flow chart showing one example of the process of treatment in the method for precluding the elution of lead according to this invention.

A degreasing step 5' is intended to remove the cutting oil and the rust-preventing oil used during the machining operation. When the degreasing work is not sufficient, it has a serious result of preventing an acid-pickling step 8 from attaining thorough removal of lead.

When the object of treatment (the valve part 1 in the present embodiment) is severely defiled, a hot water-washing step 4 performed prior to the degreasing step 5 allows effective advance removal of the defiling substance adhering to the surface thereof.

A working example of the degreasing step 5 is illustrated in Table 3. In the example shown in Table 3, an alkali chelate detergent is adopted advantageously for the purpose of preventing a chlorine type organic solvent from exerting an adverse effect on the environment and keeping an emulsion detergent from adding to a BOD.

TABLE 3

Example of the degreasing step 5

| Detergent | Temperature | Duration | Washing condition |
|---|---|---|---|
| Chlorine-based organic detergent | Normal temperature | 5 min | Immersion and supersonic washing |
| Neutral emulsion detergent | Normal temperature | 10 min | Immersion and supersonic washing |
| Alkali emulsion detergent | Normal temperature | 10 min | Immersion and supersonic washing |
| Alkali chelate detergent | 50° C. | 10 min | Immersion and swinging |
| Jet steam washing | — | 5 min | — |

When an alkali detergent is used in the degreasing step 5, the adhering alkali detergent is rinsed out thoroughly in a cold water-washing step 6 that precedes an acid-pickling step 8. It is permissible to install a plurality of cold water-washing tanks and use a mixed acid consisting of 7 wt % of nitric acid and 0.7 wt % of hydrochloric acid in the last cold water washing tank so as to effect thorough neutralization and removal of an alkali detergent component which is brought in by the movement of the container 2.

This treatment (neutralizing step 7) is intended to execute pH (hydrogen ion index) management of the main tank installed for neutralization with the object of ensuring infallible removal of a minute amount of an alkali component remaining after the cold water-washing step 6, preventing the object of treatment from being degraded by the neutralization of acid in the acid-pickling step 8 and infallibly promoting the removal of lead.

Further, this invention attaches due respect to the problem of environment and pays full attention to the cost of disposal of waste liquid as well.

As described above, this invention uses an alkali detergent in the degreasing step 5 and uses the mixed acid consisting of nitric acid (concentration a: 0.5 wt %≦a≦7 wt %) and hydrochloric acid (concentration b: 0.05 wt %≦b≦0.7 wt %) in the acid-pickling step 8 for removing lead.

To be specific, as illustrated in FIG. 3 and FIG. 4, the alkali detergent defiled in the degreasing step 5 and the mixed acid caused to contain a heavy metal in the acid-pickling step 8 are allowed to react with each other and undergo a neutralizing treatment, with the result that the precipitate and the suspended matter consequently formed will be removed as a solid substance and the oil component will be separated and disposed of as an industrial waste. Thereafter, the detoxified water that results from the neutralization may be reclaimed as industrial water.

Also, as illustrated in FIG. 3 and FIG. 4, the dilute alkaline waste liquid emanating from the cold water-washing step 6 which follows the degreasing step 5 mentioned above and the dilute acidic waste liquid emanating from the cold water-washing step 9 which follows the acid-pickling step 8 are mixed and subjected to a neutralizing treatment, with the result that the precipitate and the suspended matter which form consequently will be removed as a solid substance and the oil component will be separated and disposed of as an industrial waste. Thereafter, the detoxified water resulting from the neutralization may be reclaimed as industrial water.

When the alkali detergent used in the degreasing step 5 and the mixed acid used in the acid-pickling step 8 are so controlled that the product of the concentration (mol) of the alkali detergent multiplied by the amount thereof as a waste liquid and the product of the concentration (mol) of the mixed acid multiplied by the amount thereof as a waste liquid may approximately equal, the neutralization treatment will be executed by simply mixing these two waste liquids in the neutralizing step 7 without requiring to use an alkali or an acid solution anew and the mass production will be carried out efficiently with a generous cut of cost.

A method which implements the degreasing step and the washing step for removing lead both in an alkali solution has been known. In this case, a large amount of an acid must be separately prepared for the purpose of giving a neutralizing treatment to the waste liquid emanating from the alkali solution, and this preparation of the acid will result in greatly boosting the cost.

The method of recycling the waste liquid through an ion-exchange membrane may be conceivable. The valves that form the objects of the treatment under discussion here, however, are subjected immediately after the machining step to this treatment together with the specially designed container 2. The minute amounts of cutting oil, rust-preventing oil and other deposited matter that remain in the specially designed container 2, therefore, are contained in the waste liquid. As a result, the filtering film is clogged soon. The ion-exchange membrane is not fit for recycling the waste liquid.

Here, the temperature of the treatment and the duration of the treatment in the acid-pickling step 8 will be described.

The cleaning fluid is a mixed acid which consists of nitric acid (concentration a: 0.5 wt %≦a≦7 wt %) and hydrochloric acid (concentration b: 0.05 wt %≦b≦0.7 wt %) and the temperature of treatment x is in the range of 10° C.≦x≦50° C. and preferably in the range of normal temperature. The term "range of normal temperature" refers to the range in which the temperature of the cleaning fluid in the state neither heated nor cooled is allowed to fall. In this range, the temperature of the plumbing hardware to be treated and the temperature thereof varied by the atmosphere outside the treating tank are allowed to fall. Specifically, these temperatures fall in the range of 10° C. to 30° C. and particularly preferably in the range of 15° C. to 30° C. The optimum temperatures fall at 25° C. The duration of treatment y is preferred to be in the range of 5 minutes≦y≦30 minutes.

The reason for setting the temperature of treatment x in the range of 10° C.≦x≦50° C. will be explained.

If the temperature of treatment exceeds 50° C., the air bubbles formed by boiling in the cleaning fluid will begin to gain in prominence, tend to form air pockets in the plumbing device under treatment and prevent certain portions of the surface of the plumbing device from contacting the cleaning fluid. Further, the water and the acid will be vaporized so vigorously as to render management of the concentration of the cleaning fluid difficult, and the vapor of the acid will degrade the environment of the treating operation to the extent of necessitating adoption of a measure for acid-proofing the area of the treating operation and the workers as well. Conversely, if the temperature of treatment falls short of 10° C., the shortage will possibly result in suffering the cleaning fluid, when the cooled plumbing device enters the treating tank, to be cooled to the neighborhood of 0° C. and eventually frozen. The temperature of 10° C. or more has been determined as the temperature at which the cleaning fluid has no possibility of being frozen even when mass-produced plumbing devices are treated.

The reason for setting the duration of treatment y in the range of 5 minutes≦y≦30 minutes will be described.

If the duration of treatment exceeds 30 minutes, the overage will not result in enhancing the efficiency of the removal of lead proportionately and the overage itself will prove unfit for the purpose of quantity treatment.

If the duration of treatment falls short of 5 minutes, the shortage will result in disabling full prevention of the elution of lead even when the temperature of treatment is elevated. Hence, the lower limit is set at 5 minutes.

Figure 5:
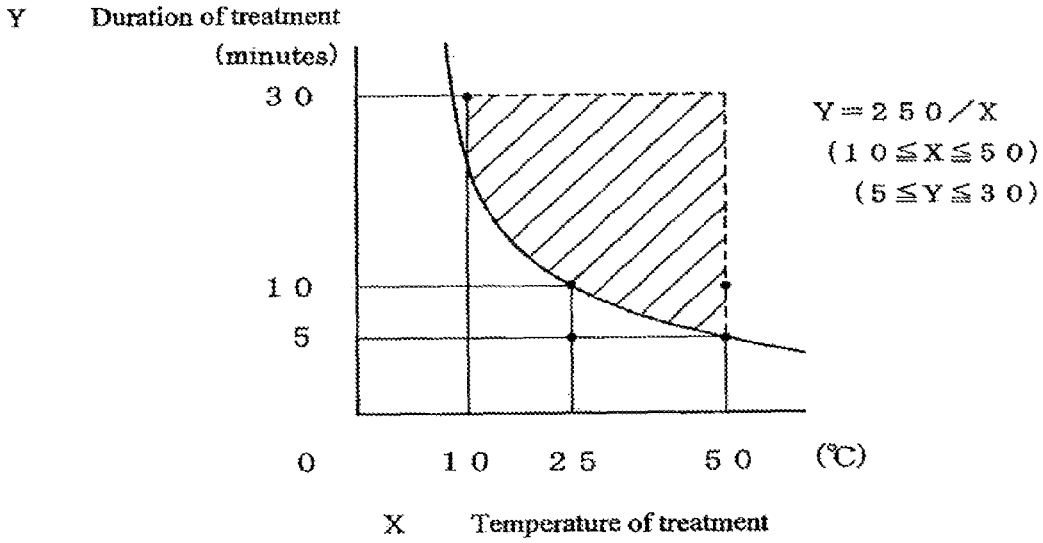
FIG. 5 is a graph depicting the results given in Table 4.

JIS10K gate valves (made of CAC406) having a nominal diameter of ½B were subjected to acid pickling at varying temperatures of treatment for varying durations of treatment and they were tested for amounts of lead elution. The results of the test are shown in Table 4 and the results of Table 4 are plotted in FIG. 5.

The amounts of lead eluted were corrected values obtained of a given sample installed halfway along the length of a piping and operated as a plumbing utensil for conditioning and elution tests in accordance with the provision of JIS S3200-7 "Method for testing a plumbing utensil for property of elution."

TABLE 4

Results of test for lead elution after acid pickling

| Concentration of chemical solution | Temperature | Duration | Amount of lead eluted (mg/l) |
|---|---|---|---|
| Nitriclacid 4 wt % Hydrochloric acid 0.4 wt % | 10° C. | 30 min | 0.004 |
| Nitric acid 4 wt % Hydrochloric acid 0.4 wt % | 25° C. | 10 min | 0.005 |
| Nitric acid 4 wt % Hydrochloric acid 0.4 wt % | 50° C. | 10 min | 0.002 |
| Nitric acid 4 wt % Hydrochloric acid 0.4 wt % | 25° C. | 5 min | 0.012 |
| Nitric acid 4 wt % Hydrochloric acid 0.4 wt % | 50° C. | 5 min | 0.003 |

As shown in Table 4, in the test run using a temperature of 25° C. and duration of 5 minutes, the amount of lead eluted was large and consequently the removal of lead was insufficient.

Under the conditions of treatment using a temperature of 50° C. and duration of 10 minutes and those using a temperature of 50° C. and duration of 5 minutes, the amounts of lead eluted were approximately equal. This fact indicates that the duration of treatment did not need to be so much as 10 minutes.

It is noted from the results of test given in Table 4 that when the washing was performed under the conditions fulfilling y=250/x (Temperature of treatment 10° C.≦x≦50° C. and duration of treatment 5 minutes≦y≦30 minutes), a plumbing device of copper alloy conforming to the rigid standard of lead elution of not more than 0.01 mg/l could be obtained.

The present embodiment is applicable to the existing valves. In this application, since parts, such as packing and gaskets, which are made of nonmetallic substances are fated to be immersed in the cleaning fluid, due consideration is required to be paid to the possibility of these parts being degraded, depending on the duration of cleaning, the temperature and the concentration of the cleaning fluid. In this case, therefore, it is commendable to have these parts made of a chemical-resistance material, such as fluorine-containing rubber.

Incidentally, in the present embodiment, since the plated (chromium and nickel) parts, such as the main bodies of valves, do not succumb to phenomena of corrosion, such as discoloration and pitting, therefore, plumbing devices made of copper alloy, such as valves, water faucet fittings and tube couplings, are at an advantage in tolerating an acid pickling in the state of finished products.

As illustrated in FIG. 3, the degreasing step 5 and the acid-pickling step 8 are each provided with a plurality of treating tanks that are interconnected as with pipes. This system admits new chemical solutions via the tank on the most upstream side for replenishment and discharges a waste liquid via the tank on the most downstream side. As a result, the amount of spent chemical solutions to be disposed of is decreased to the fullest possible extent.

Since the container 2 advances along the process while it sequentially moves to the component layers, it is in the first tanks respectively of the degreasing step 5 and the acid-pickling step 8 that the chemical solutions are remarkably deteriorated.

The spent chemical solutions are extracted from the first tanks respectively of the component steps as illustrated in FIG. 3. The alkali detergent and the mixed acid detergent are subjected to a neutralizing reaction and the solid heavy metals consequently precipitated are separated by filtration and discarded as a waste substance. The detoxified water of neutralization is released in its unmodified form into the nearby sewer. As a result, the cost incurred in the disposal of spent chemical solutions can be decreased.

Incidentally, the neutralizing step 7 and the rust-preventing step 10 which will be specifically described herein below are not engaged to dispose of any waste liquid but serve only to replenish chemical solutions that have been spontaneously loss.

As the cleaning fluid, a mixture obtained by mixing an acid, such as nitric acid, which corrodes lead with tap water or purified water or a mixture obtained by intermingling a mixed acid consisting of nitric acid and hydrochloric acid possessing an inhibitor effect and tap water or purified water is used. In this case, since the $Cl^-$ ions of hydrochloric acid corrode a copper surface while forming a film uniformly thereon, the mixture corrodes the copper surface while keeping the glossy copper surface intact.

At this time, the corrosion lasts because the lead part forms lead chloride and lead nitrate and these salts are both compatible with the mixed acid.

Now, the acids that are contained in the cleaning fluid will be described.

Generally, acids are known to corrode (oxidize) lead. Since lead is liable to form an oxidized coating film by reacting with such an acid, the corrosion does not easily occur continuously. Nitric acid, hydrochloric acid, and an organic acid, such as acetic acid, however, corrode lead continuously. Among other acids mentioned above, nitric acid ($HNO_3$) exhibits the highest speed of corrosion.

Hydrochloric acid (HCl) exhibits a high combining power for copper in spite of a slow lead-corroding speed as compared with nitric acid. When the mixture thereof with nitric acid is used for acid pickling, the hydrochloric acid manifests the so-called inhibitor effect of suppressing the corrosion of copper with nitric acid by forming a copper chloride (CuCl) coating film on the surface of a valve before nitric acid and copper undergo a chemical reaction and form copper oxide ($Cu_2O$ or CuO). Owing to the inclusion of hydrochloric acid, therefore, the oxidation of copper on the surface of a valve is eliminated and the inconvenience of black discoloration is prevented and, as a result, the gloss of metal is maintained.

The treating fluid for washing the plumbing hardware made of a copper alloy according to this invention is a cleaning fluid which gives a cleaning treatment to at least the liquid-contacting part of the plumbing device made of a copper alloy possessing both or either of lead and nickel and serves to remove both or either of lead and nickel. It is a treating fluid formed of a mixed acid consisting of nitric acid and hydrochloric acid added as an inhibitor thereto. As described specifically herein below, it can be used as a proper treating fluid on all plumbing devices possessing both or either of lead and nickel, let alone plumbing devices made of a copper alloy and having a surface plated with a nickel alloy, with the object of removing both or either of lead and nickel from the devices.

After undergoing the acid-pickling step 8, the valves are promptly given cold water washing (the cold water-washing step 9) and immersed in phosphoric acid and an aqueous solution of a phosphate (the rust-preventing step 10). Since zinc is eluted and removed together with lead in the acid-pickling step 8, the valves which are now liable to gather rust when dried and left standing in the air are subjected to a rust-preventing treatment as immersed in phosphoric acid and the aqueous solution of a phosphate.

Since this treatment is carried out in the aqueous solution at a temperature in the range of 70 to 80° C., it concurrently serves as a hot water-washing step. One example of the rust-preventing step 10 is shown in Table 5.

TABLE 5

Example of rust-preventing step 10

| Concentration of chemical solution | Temperature | Duration |
|---|---|---|
| Commercially available phosphoric acid film solution, 1 wt % | 70° C. | 5 min |

Though this example used a treatment of phosphoric acid film for the rust-preventing treatment, the treatment may resort to a commercially available rust-preventing agent having benzotriazole as a component. One examples of this treatment is shown in Table 6.

TABLE 6

Example of film treating step resorting to benzotriazole

| Step of treatment | Temperature | Duration |
|---|---|---|
| Hot water washing step | 70° C. | 5 min |
| Rust-preventing step using a commercially available rust-preventing agent having benzotriazole as a component | 40° C. | 20 sec |

The container 2 that has passed all the steps is advanced to an assembling step, at which the valve parts (or coupling parts) are extracted from the container 2 and assembled and inspected. The valve parts do not need to be perfectly dried because they are given a submerging test once again in the inspecting step.

Table 7 shows the results of a test of CAC406 products for lead elution after the treatment and Table 8 shows the results of a test of C3771 products for lead elution after the treatment.

TABLE 7

Results of test of CAC406 products for lead component elution

| Step | Condition for execution | Duration of treatment |
|---|---|---|
| Hot water washing step | Hot water washing tank at 50° C. | 5-min immersion |
| Degreasing step | Alkali chelate detergent, 50 g/l, at 50° C. | 10-min immersion |
| Cold water washing step | Normal room temperature | 10-min immersion |
| Cleaning step | Mixed acid consisting of 4 wt % of nitric acid and 0.4 wt % of hydrochloric acid at normal room temperature | 10-min immersion |
| Cold water washing step | Normal room temperature | 10-min immersion |
| Rust preventing step | Commercially available phosphoric acid coating film solution, 1 wt %, at 70° C. | 30-sec immersion |
| Result of test for elution | Bronze valve 10K screw type gate valve having nominal diameter of 1/2, used as a sample, JIS B2011 | 0.003 mg/l |

TABLE 8

Results of test of C3771 products for lead component elution

| Step | Condition for execution | Duration of treatment |
|---|---|---|
| Hot water washing step | Hot water washing tank at 50° C. | 5-min immersion |
| Degreasing step | Alkali chelate detergent, 50 g/l, at 50° C. | 10-min immersion |
| Cold water washing step | Normal room temperature | 10-min immersion |
| Cleaning step | Mixed acid consisting of 4 wt % of nitric acid and 0.4 wt % of hydrochloric acid at normal room temperature | 10-min immersion |
| Cold water washing step | Normal room temperature | 10-min immersion |
| Rust preventing step | Commercially available phosphoric acid coating film solution, 1 wt %, at 70° C. | 30-sec immersion |
| Result of test for elution | Screw type gate valve, .125 type, made of brass and having nominal diameter of 1/2, used as a sample | 0.003 mg/l |

As a result, the CAC406 product and the C3771 product both were enabled to have the amount of lead elution to be decreased to such a very minute amount of 0.003 mg/l as shown in Table 7 and Table 8.

Next, one embodiment of the method for precluding elution of lead and nickel according to this invention will be described with reference to the drawings annexed hereto.

In the same manner as in the method for precluding lead elution described above, valve parts (or couplings, tap parts, etc.) 1 which have been cast and then machined are so arranged inside a specially designed reticular container 2 resistant to heat and to chemicals as to avoid colliding with and inflicting marks and scratches on one another during the course of conveyance as illustrated in FIG. 1. During the arrangement, it is proper for the workpieces to be disposed so that the air bubbles occurring therein may be expelled upwardly or laterally lest they should stagnate therein and give rise to air pockets 11.

Since the valves have a complicated shape, all the liquid contacting portions of the valve parts 1 are enabled during the immersion in the treating vessel to contact the cleaning fluid by imparting a vibration or a supersonic stimulation to the valve parts, thereby removing thoroughly the air bubbles remaining in a small amount therein.

All the steps of the process are performed on the valve parts 1 that are set fast in the specially designed container 2. After undergoing the process, the valve parts 1 are withdrawn from the specially designed container 2 and advanced to the assembling process. The valve parts may be given an acid pickling in the form of finished products (valves in the present embodiment) each composed of a plurality of valve parts that have been cast and then machined.

The individual steps of the method for precluding elution of lead and nickel according to this invention will be described.

Figure 6:
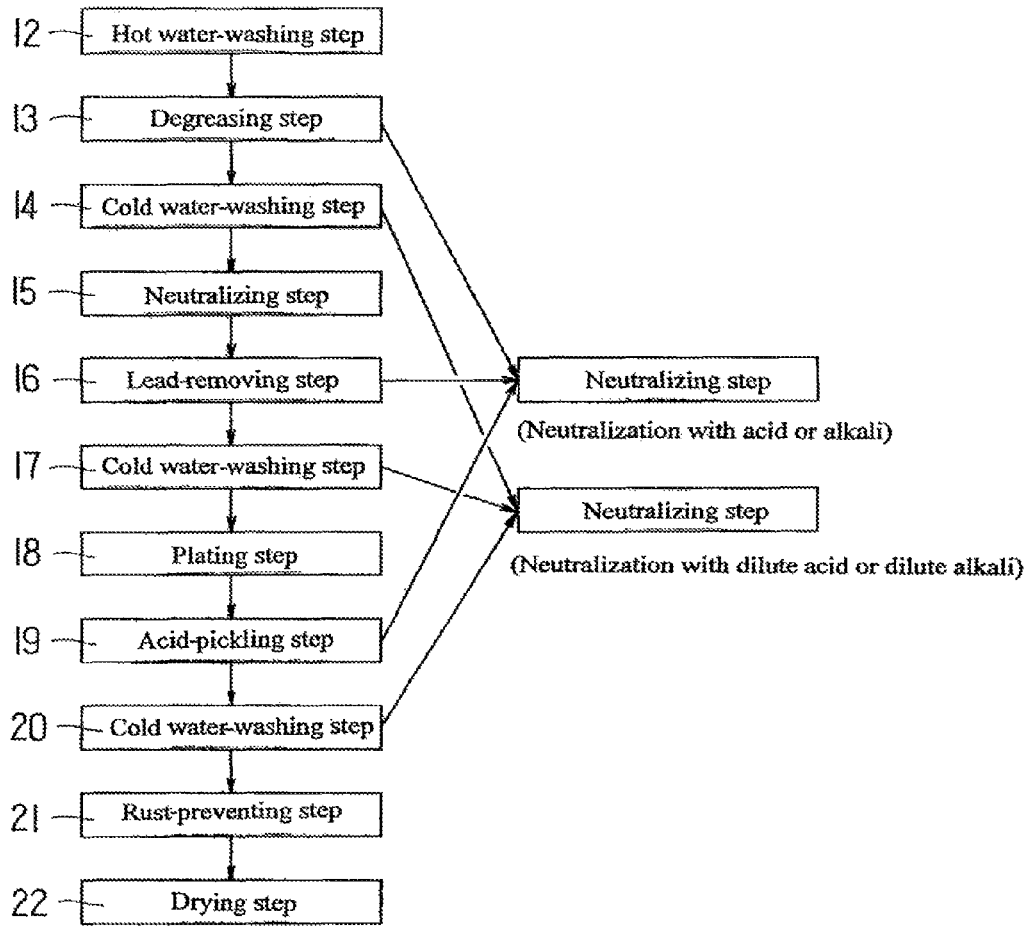
FIG. 6 is a flow chart illustrating one example of a process for performing a treatment for precluding elution of lead or nickel in accordance with this invention.

FIG. 6 is a flow chart showing one example of the process of treatment in the method for precluding elution of lead and nickel according to this invention. This process of treatment is proper particularly for such plumbing hardware that has a comparatively large lead content.

A hot water-washing step 12, a degreasing step 13, a cold water-washing step 14 following the degreasing step 13, and a neutralizing step 15 which form the method for precluding elution of lead and nickel in the present embodiment have the same treating conditions respectively as the hot water-washing step 4, the degreasing step 5, the cold water-washing step 6 following the degreasing step 5, and the neutralizing step 7 forming the method for precluding elution of lead.

In the present embodiment, a lead-removing step 16 is inserted prior to a plating step 18 as illustrated in FIG. 6. This lead-removing step 16 adopts the same conditions of treatment as the acid-pickling step 8 of the method for precluding elution of lead. The cleaning fluid, therefore, is a mixed acid consisting of nitric acid (concentration a: 0.5 wt %≦a≦7 wt %) and hydrochloric acid (concentration b: 0.05 wt %≦b≦0.7 wt %). This step does not need to be limited to this embodiment but may be replaced by an acid-pickling treatment or an alkali-pickling treatment to be performed under different conditions. In the case of such a plumbing device as tends to induce segregation of lead on the metallic surface thereof, a treatment of chemical polishing may be given to the device prior to the lead-removing step 16.

Subsequent to the lead-removing step 16, the cleaning fluid adhering to the valves is removed thoroughly in a cold water-washing step 17. When necessary, this cold water-washing step 17 may be omitted or a drying step may be set prior to the cold water-washing step 17.

A plating step 18 is intended for a known plating treatment. In the present embodiment, the plating step 18 adopts a nickel chromium-plating treatment.

An acid-pickling step 19 adopts approximately identical treating conditions as the acid-pickling step 8 in the method for precluding elution of lead described above. The cleaning fluid, therefore, is a mixed acid consisting of nitric acid (concentration c: 0.05 wt %<c<7 wt %) and hydrochloric acid (concentration d: 0.05 wt %<d<0.7 wt %). Though this acid-pickling step 19 is aimed at removing nickel, this acid-removing step 19 may execute nickel removal and lead removal as demonstrated in another embodiment that will be described herein below.

In the present example, since the cleaning fluid for the acid-pickling step 19 and the cleaning fluid for the lead-removing step 16 described above are approximately identical in composition and concentration, they do not need to have a plurality of kinds of cleaning fluid prepared. Thus, the cleaning fluid that has been used in the lead-removing step 16 may be used in the acid-pickling step 19 and the amount of spent chemical solutions to be disposed of can be decreased. The repeated uses of the cleaning fluid is feasible because the mixed acid of this invention consisting of nitric acid (concentration a: 0.5 wt %≦a≦7 wt %) and hydrochloric acid (concentration b: 0.05 wt %≦b≦0.7 wt %) has degradation of the ability to effect the intended removal moderated and it entails virtually no discoloration even when the treatment for the removal of lead is continued.

The valves, after undergoing the acid-pickling step 19, are promptly washed with cold water in the cold water-washing step 20 and then immersed in phosphoric acid and an aqueous solution of a phosphate in a rust-preventing step 21. Incidentally, the conditions of treatment in the rust-preventing step 21 are identical with the conditions of treatment of the rust-preventing step 10 in the method for precluding elution of lead.

This example has a drying step 22 for removing the adhering moisture with warm air at 70° C. for about 5 minutes inserted subsequent to the rust-preventing step 21.

Here, the elution of nickel from a plumbing device that has undergone a nickel-plating treatment will be described.

The nickel chromium plating which is one form of the electroplating treatment is implemented by immersing a given plumbing device in a plating fluid and causing the outer surface of the plumbing device opposed to an electrode to form thereon a layer of chromium with nickel as a binder. The inner surface of the plumbing device (the surface of the liquid-contacting part) has been considered to have no presence of nickel because it is not opposed to the electrode and, therefore, is not caused to form a plated layer. Actually, however, the presence of a nickel component on the inner surface has been confirmed in consequence of the analysis by the use of the EPMA (X-ray microanalyzer) that will be specifically described herein below. As a result of a further analysis, it has been elucidated that this nickel is not metallic nickel originating in the plating treatment but has occurred when the nickel salt component in the plating fluid (nickel nitrate and nickel chloride) persists inside the plumbing device even after the plating step, dries, and adheres to the inner surface of the plumbing device.

The results of the analysis by the use of the EPMA (X ray microanalyzer) are shown in Table 9.

Figure 7:
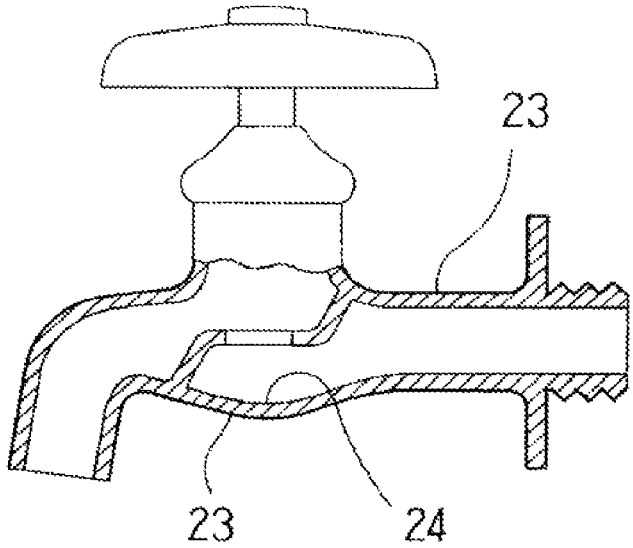
FIG. 7 is a cross section of a sample showing the region subjected to the analysis with an EPMA (X-ray microanalyzer).

The analysis was carried out by using as samples a JIS wall faucet (made of CAC406) plated in advance with nickel chromium and having a nominal diameter of 25 mm and an inner volume of 40 ml and a JIS wall faucet (made of CAC406) given no plating treatment and having a nominal diameter of 25 mm and an inner volume of 40 ml under the conditions using a plane of 3 mm×2 mm with the object of detecting metal elements in the metal surface layer. FIG. 7 shows the regions of analysis by the EPMA (X ray microanalyzer). In the diagram, numeral 23 denotes a plated layer and 24 denotes a region of analysis by the EPMA (X ray microanalyzer).

TABLE 9

| Sample | Amount of nickel detected (wt %) |
|---|---|
| No plating made | 0.1 |
| Plating made | 2.39 |

While the inner surface of the sample which had not been given a plating treatment with nickel chromium showed a nickel content of 0.1 wt %, the inner surface of the sample which had been given a plating treatment with nickel chromium showed a nickel content of 2.39 wt % as shown in Table 9.

Figure 8:
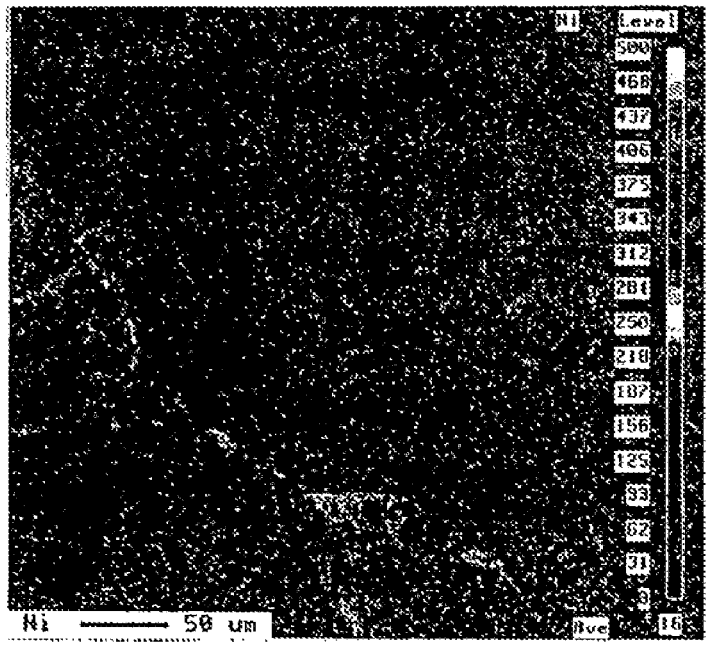
FIG. 8 is a photograph showing the nickel distribution produced by the EPMA (X-ray microanalyzer) on the inner surface of a JIS (Japanese Industrial Standard) wall faucet (made of CAC406) plated with nickel chromium.
Figure 9:
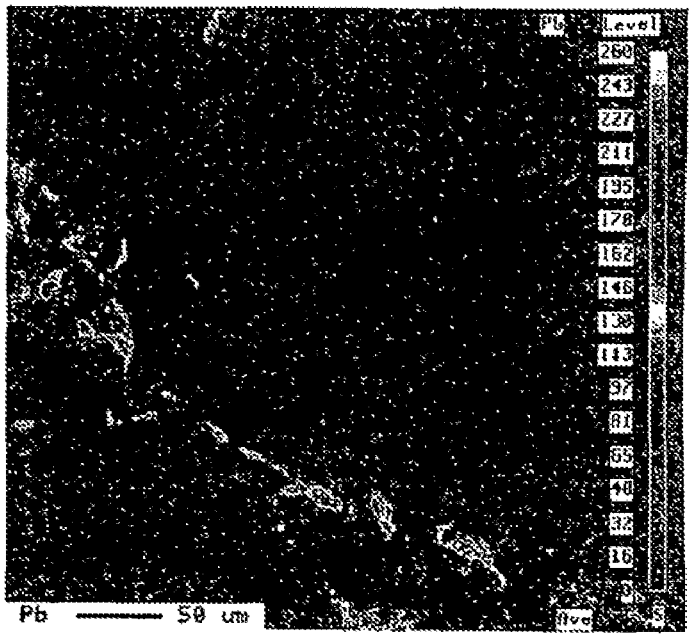
FIG. 9 is a photograph showing the lead distribution produced by the EPMA (X-ray microanalyzer) on the inner surface of a JIS wall faucet (made of CAC406) plated with nickel chromium.

FIG. 8 is a photograph showing a nickel distribution found on the JIS wall faucet (made of CAC406) given a plating treatment with nickel chromium and having a nominal diameter of 25 mm and an inner volume of 40 ml and FIG. 9 is a photograph showing a lead distribution. An electric current of 10 nA was used for the irradiation.

Figure 10:
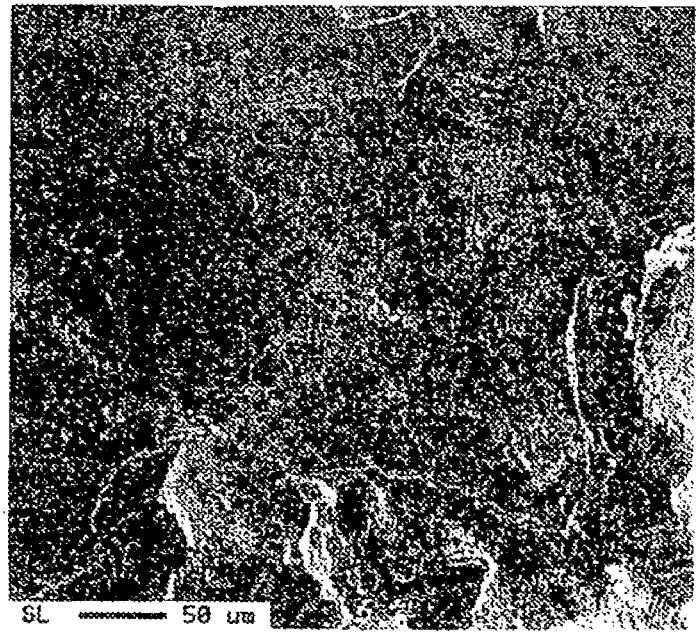
FIG. 10 is an electron photomicrograph of the inner surface of a JIS wall faucet (made of CAC406) plated with nickel chromium.

On the inner surface of the sample (made of CAC406) that had been given a plating treatment with nickel chromium, nickel and lead were found to exist partially at approximately equal positions of the surface tested as shown in FIG. 8 and FIG. 9. It is clear from the electron photomicrograph of FIG. 10 that the positions of presence of these two elements agree with the positions of crystal grain boundaries on the metal surface.

In a plumbing device, such as a faucet, which possesses a complicated flow path, since the gaps between the adjacent sand grains incur a locally delayed cooling, the gas emanating from the molten metal gathers in the gaps and eventually coagulates, with the result that lead of a low melting point will be crystallized in the surface layer, particularly at the positions of crystal grain boundaries, of the plumbing device. Since the positions of these crystal grain boundaries form depressed parts, it is inferred that lead 26 is segregated in crystal grain boundaries 25 and the plating fluid remains in the depressed parts thereon and dries so as to induce deposition of a nickel salt 27. Since a plumbing hardware, such as a faucet, possesses a complicate flow path and incurs difficulty in expelling the residual plating fluid from the interior thereof, it is inferred that the adhesion of the nickel salt becomes conspicuous.

Figure 11:
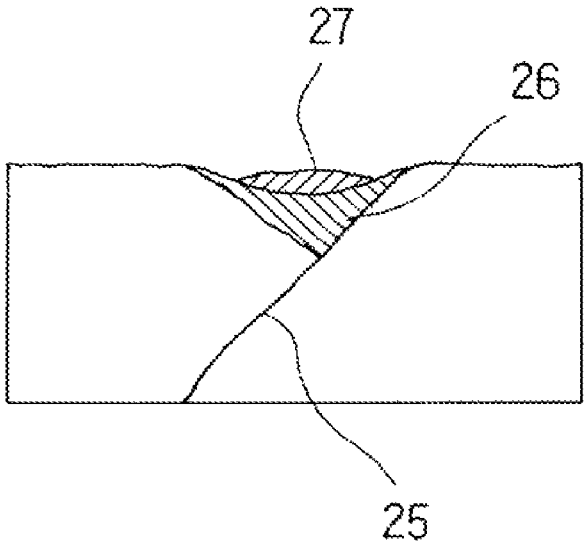
FIG. 11 is an explanatory diagram illustrating the condition of presence of lead and/or nickel in crystal grain boundaries on the inner surface of a plumbing device plated with nickel.

From this speculation, it is further inferred that the lead 26 is segregated on the crystal grain boundary 26 and the nickel salt 27 of the plating fluid is deposited thereon as illustrated in FIG. 11.

On the outer surface (plated surface) of the sample which had undergone a nickel chromium-plating treatment, nickel and chromium which are the components of the plating fluid were detected throughout the entire surface for analysis and no chlorine was detected on either the outer surface (plated surface) or the inner surface, though not illustrated.

From the results reported above, it is inferred that nickel was deposited on the inner surface of the plumbing device that had undergone the nickel-plating treatment.

Next, the acid-pickling treatment contemplated by this invention was applied to a CAC406 product and the sample was tested for elution of lead and nickel. The results of this analysis are shown in Table 10.

The sample was a nickel chromium plated JIS wall faucet (made of CAC406) having a nominal diameter of 25 mm and an inner volume of 40 ml. The acid-pickling treatment was carried out under the conditions of 4 wt % of nitric acid+0.4 wt % of hydrochloric acid in fluid composition, 25° C. in treating temperature, and 10 minutes in duration of treatment, with the sample wholly subjected to an immersing treatment. The amounts of elution were corrected values obtained of a given sample installed at the trailing terminal of a piping and operated as a plumbing utensil for conditioning and elution tests in accordance with the provision of JIS S3200-7 "Method for testing a plumbing utensil for property of elution."

TABLE 10

| Condition of treatment | Amount of lead eluted (mg/l) | Amount of nickel eluted (mg/l) |
|---|---|---|
| Untreated product | 0.04 | 0.05 |
| Product treated by acid pickling | 0.003 | 0.002 |

As shown in Table 10, the sample given no acid-pickling treatment (untreated product) was found to have lead elution of 0.04 mg/l and the sample given an acid-pickling treatment (acid-pickled product) was found to have lead elution of 0.003 mg/l. Then, the sample given no acid-pickling treatment (untreated product) was found to have nickel elution of 0.05 mg/l and the sample given an acid-pickling treatment (acid-pickled product) was found to have nickel elution of 0.002 mg/l. Thus, the acid-pickling treatment contemplated by this invention was confirmed to allow a given sample to satisfy the lead elution standard of not more than 0.01 mg/l and the nickel elution standard of not more than 0.01 mg/l or 0.02 mg/l.

Next, the acid-pickling treatment contemplated by this invention was applied to a C3771 product and the sample was tested for elution of lead and nickel. The results of this analysis are shown in Table 11.

The sample was a nickel-chromium-plated 10K ball valve (made of C3771) having a nominal diameter of ½ inch. The acid-pickling treatment was carried out under the conditions of 4 wt % of nitric acid+0.4 wt % of hydrochloric acid in fluid composition, 25° C. in treating temperature, and 10 minutes in duration of treatment, with the sample wholly subjected to an immersing treatment. The amounts of elution were corrected values obtained of a given sample installed halfway along the length of a piping and operated as a plumbing utensil for conditioning and elution tests in accordance with the provision of JIS S3200-7 "Method for testing a plumbing utensil for property of elution."

TABLE 11

| Condition of treatment | Amount of lead eluted (mg/l) | Amount of nickel eluted (mg/l) |
|---|---|---|
| Untreated product | 0.008 | 0.015 |
| Product treated by acid pickling | 0.001 | 0.001 |

As shown in Table 11, the sample given no acid-pickling treatment (untreated product) was found to have lead elution of 0.008 mg/l and the sample given an acid-pickling treatment (acid-pickled product) was found to have lead elution of 0.001 mg/l. Then, the sample given no acid-pickling treatment (untreated product) was found to have nickel elution of 0.015 mg/l and the sample given an acid-pickling treatment (acid-pickled product) was found to have nickel elution of 0.001 mg/l. Thus, the acid-pickling treatment contemplated by this invention was confirmed to allow a given sample to satisfy the lead elution standard of not more than 0.01 mg/l and the nickel elution standard of not more than 0.01 mg/l or 0.02 mg/l.

Figure 12:
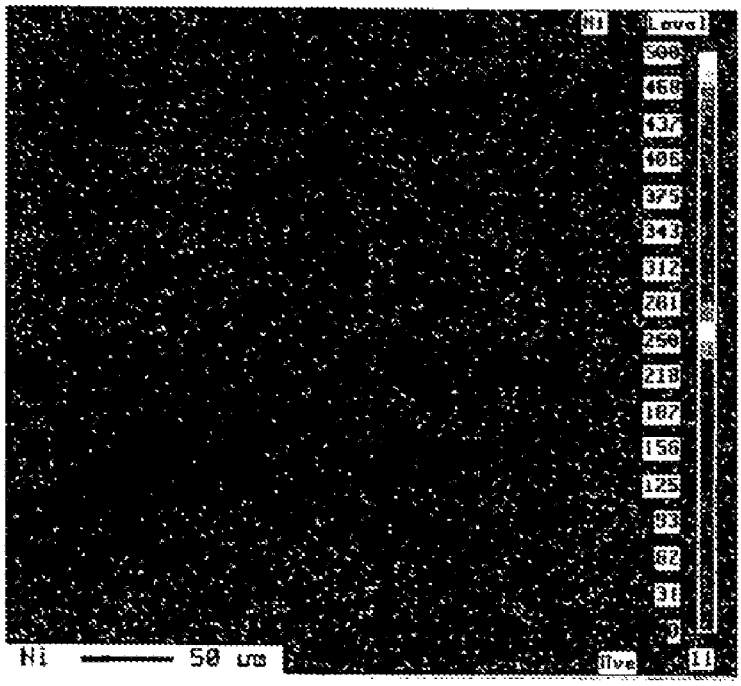
FIG. 12 is a photograph showing the nickel distribution produced by the EPAM (X-ray microanalyzer) on the inner surface (formed of CAC406) of the JIS wall faucet (made of CAC406) placed with nickel chromium after undergoing the treatment of acid pickling according to this invention.
Figure 13:
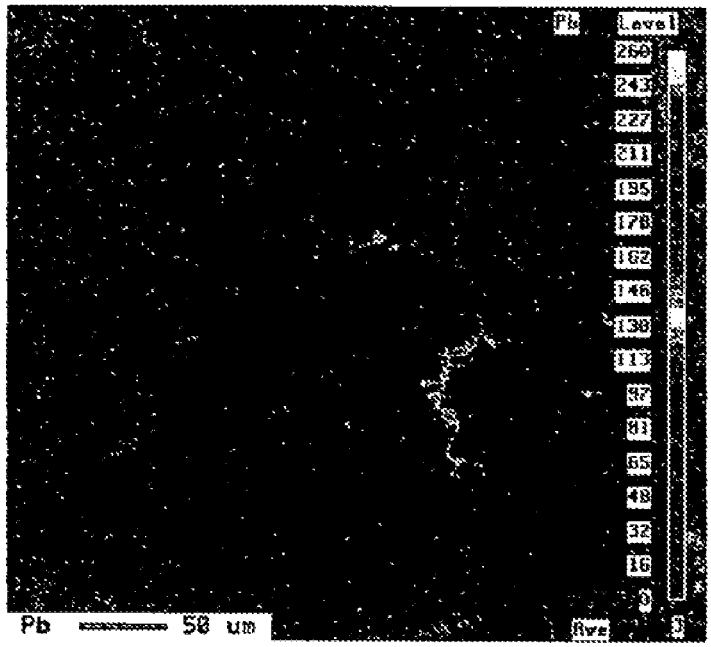
FIG. 13 is a photograph showing the lead distribution produced by the EPAM (X-ray microanalyzer) on the inner surface (formed of CAC406) of the JIS wall faucet (made of CAC406) placed with nickel chromium after undergoing the treatment of acid pickling according to this invention.
Figure 14:
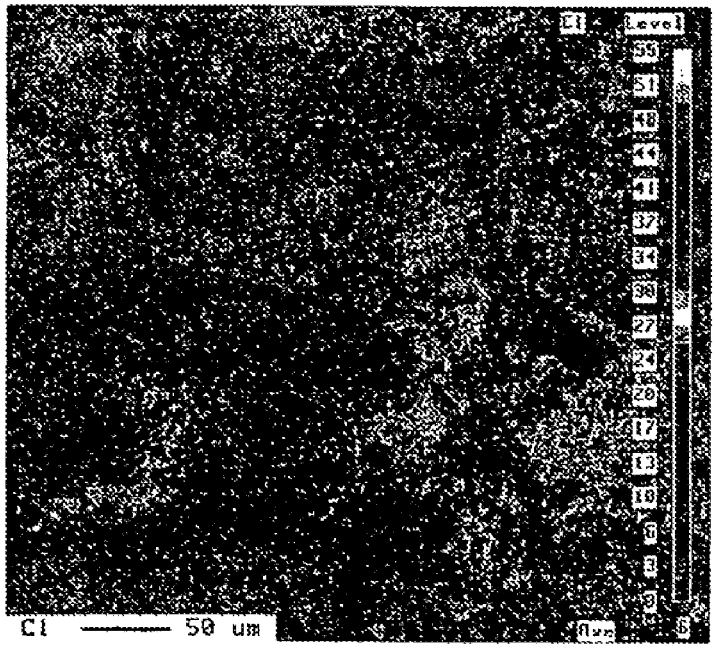
FIG. 14 is a photograph showing the chlorine distribution produced by the EPAM (X-ray microanalyzer) on the inner surface (formed of CAC406) of the JIS wall faucet (made of CAC406) plated with nickel chromium after undergoing the treatment of acid pickling according to this invention.

FIG. 12 is a photograph showing the distribution of nickel. FIG. 13 is a photograph showing the distribution of lead, and FIG. 14 is a photograph showing the distribution of chlorine respectively obtained by the EPMA (X ray microanalyzer) on the inner surface of a nickel chromium-plated JIS wall faucet (made of CAC406) having a nominal diameter of 25 mm and an inner volume of 40 ml after being subjected to the acid-pickling treatment contemplated by this invention.

It has been confirmed that nickel ceased to exist in consequence of complete removal as shown in FIG. 12 and that lead was nearly wholly removed as shown in FIG. 13. Incidentally, on the inner surface after the acid-pickling treatment, chlorine was detected throughout the entire surface under test and a film was formed of $Cl^-$ ions on the front surface of the liquid-contacting part as shown in FIG. 14. Then, on the outer surface (plated surface) after the acid-pickling treatment, nickel and chromium that were the components of the placing fluid were detected throughout the entire surface under test and they had absolutely no effect on the outward appearance of the plated surface, though not illustrated.

According to the aid-pickling treatment contemplated by this invention, nitric acid (concentration c: 0.5 wt %<c<7 wt %) and hydrochloric acid (concentration d: 0.05 wt %<d<0.7 wt %), particularly nitric acid, first act on nickel and remove the nickel from the surface of a given plumbing device in the form of nickel nitrate and thereafter immediately act on lead existing underneath the nickel and remove it. Thus, the acid-pickling treatment performed just once succeeds in simultaneously removing lead and nickel.

Incidentally, nickel is a material that resists the corrosion with alkalis, such as sodium hydroxide, and sulfuric acid, for example. Therefore, it cannot be removed by means of such liquids irrespective of their concentrations and temperatures.

When a nickel chromium-plated plumbing device is treated in the manner described above, while this invention succeeds in removing lead and nickel, the treatment with an alkali and sulfuric acid incurs difficulty in removing the lead lying underneath the nickel.

As already described in the foregoing description of the method for precluding lead elution, this invention directs respect to the problem of environment and as well pays a due attention to the cost of disposal of a waste liquid.

This invention uses an alkali detergent in the degreasing step 13 and a mixed acid consisting of nitric acid (concentration c: 0.5 wt %<c<7 wt %) and hydrochloric acid (concentration d: 0.05 wt %<d<0.7 wt %) in the acid-pickling step 19 for the purpose of removing nickel.

To be specific, as illustrated in FIG. 6, the alkali detergent defiled in the degreasing step 13 and the mixed acid caused to contain a heavy metal in the acid-pickling step 19 are allowed to react with each other and undergo a neutralizing treatment, with the result that the precipitate and the suspended matter consequently formed will be removed as a solid substance and the oil component will be separated and disposed of as an industrial waste. Incidentally, in the present embodiment, since the cleaning fluid used in the lead-removing step 16 is identical with the cleaning fluid used in the acid-pickling step 19, it is caused to react with the alkali detergent defiled in the degreasing step 13 and undergo a neutralizing treatment, with the result that the precipitate and the suspended matter consequently formed will be removed as a solid substance and the oil component will be separated and disposed of as an industrial waste. Thereafter, the detoxified water of neutralization consequently obtained may be reclaimed as industrial water.

Then, as illustrated in FIG. 6, the dilute alkaline waste liquid emanating from the cold water-washing step 14 following the degreasing step 13 and the dilute acidic waste liquid emanating from the cold water-washing step 17 following the lead-removing step 16 and the cold water-washing step 20 following the acid-pickling step 19 are mixed and subjected to a neutralizing treatment, with the result that the precipitate and the suspended matter consequently formed will be removed as a solid substance and the oil component will be separated and disposed of as an industrial waste. Thereafter, the detoxified water of neutralization consequently obtained may be reclaimed as industrial water. The varying discharged liquids may be detoxified by a neutralizing treatment with the existing plating fluids. Thus, these discharged liquids do not necessitate new provision for waste liquid disposal.

In the present embodiment, the alkaline waste liquids emanating from the degreasing step 13 and the cold water-washing step 14 are put to use. They need not be used, however, where the known alkali-pickling treatment is already used for the removal of lead.

The concept of causing the alkaline waste liquid and the acidic waste liquid used in the series of treating steps to undergo a neutralizing treatment as described above characterizes this invention.

When the alkaline detergent spent in the degreasing step 13 and the mixed acid spent in the lead-removing step 16 and the acid-pickling step 19 are so controlled that the product of the concentration of the spent alkali detergent multiplied by the amount thereof discharged and the product of the concentration of the spent mixed acid multiplied by the amount thereof discharged may approximately equal, the neutralizing treatment can be executed by simply fixing the two waste liquids without requiring to use an alkali or acid solution anew in the neutralizing step 15. Thus, the neutralization treatment can be effected efficiently with a general cut in the cost of mass production.

Next, another example of the method for precluding elution of lead and nickel according to this invention will be described.

Figure 15:
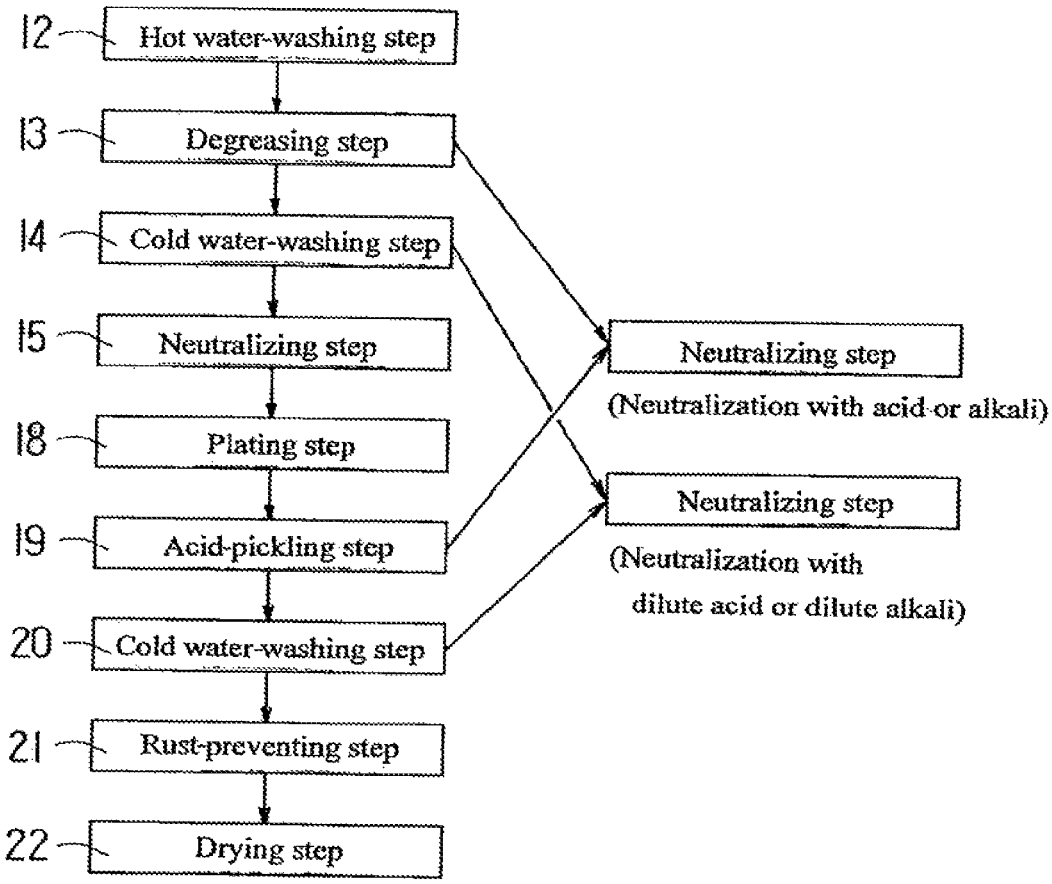
FIG. 15 is a flow chart showing another example of the process for the treatment for precluding elution of lead or nickel according to this invention.

FIG. 15 is a flow chart illustrating the other example of the process of treatment in the method for precluding elution of lead and nickel contemplated by this invention. This process of treatment is particularly suitable for a plumbing device that contains no lead or has a comparatively small lead content.

The hot water-washing step 12, the degreasing step 13, and cold water-washing step 14 following the degreasing step 13, and the neutralizing step 15 which form the method for precluding elution of lead and nickel in the present embodiment have the same treating conditions respectively as the hot water-washing step 4, the degreasing step 5, the cold water-washing step 6 following the degreasing step 5, and the neutralizing step 7 used in the aforementioned method for precluding elution of lead. No lead-removing step is imparted prior to the plating step 18 as illustrated in FIG. 15 and the removal of lead and nickel is executed in the acid-pickling step 19. The plating step 16, the acid-pickling step 19, and cold water-washing step 20 following the acid-pickling step 19, the rust-preventing step 21, and the drying step 22 have the same treating conditions as used in the relevant steps in the aforementioned method for precluding elution of lead and nickel.

The acid-pickling treatment contemplated by this invention was applied to a C3771 product at a varying temperature of treatment for a varying duration of treatment and the samples resulting from the treatments of varying temperature and duration were tested to determine their amounts of elution of lead and nickel. The results of the test are shown in Table 12.

The samples used for the test were those of a nickel chromium-plated JIS10K ball valve (made of C3771) having a nominal diameter of ½ inch. The amounts of lead elution were corrected values obtained of a given sample installed halfway along the length of a piping and operated as a plumbing utensil for conditioning and elution tests in accordance with the provision of JIS S3200-7 "Method for testing a plumbing utensil for property of elution."

TABLE 12

| Concentration of Chemical solution | Temperature | Duration | Amount of lead eluted (mg/l) | Amount of nickel eluted (mg/l) |
|---|---|---|---|---|
| Nitric acid 4 wt % Hydrochloric acid 0.4 wt % | 10° C. | 30 min | 0.002 | 0.003 |

TABLE 12-continued

| Concentration of Chemical solution | Temperature | Duration | Amount of lead eluted (mg/l) | Amount of nickel eluted (mg/l) |
|---|---|---|---|---|
| Nitric acid 4 wt % Hydrochloric acid 0.4 wt % | 25° C. | 10 min | 0.002 | 0.001 |
| Nitric acid 4 wt % Hydrochloric acid 0.4 wt % | 50° C. | 10 min | 0.001 | 0.001 |
| Nitric acid 4 wt % Hydrochloric acid 0.4 wt % | 25° C. | 5 min | 0.009 | 0.009 |
| Nitric acid 4 wt % Hydrochloric acid 0.4 wt % | 50° C. | 5 min | 0.002 | 0.001 |

It has been confirmed that by executing the cleaning under the conditions satisfying y=250/x (treating temperature: 10° C.≦x≦50° C. and treating duration: 5 minutes≦y≦30 minutes), the standard of lead elution of not more than 0.01 mg/l and the guideline of nickel elution of not more than 0.1 mg/l or 0.02 mg/l can be satisfied without requiring any addition to the temperature of treatment or the duration of treatment.

As already mentioned in the foregoing description of the embodiment, this invention directs respect to the problem of environment and as well pays a due attention to the cost of disposal of a waste liquid. Since this point has been already explained in the embodiment described above, it will be omitted from the following description.

The acid-pickling treatment contemplated by this invention was given to a CAC406 product under varying conditions and the samples resulting from the treatment were tested to determine the amounts of nickel elution. The results of the test are shown in Table 13. The amounts of Ni elution and Ni removal are reported in the denomination of mg/l and the reaction velocity of the Ni removal is reported using the unit of mg/1.

The samples for this test were those of a nickel chromium-plated JIS wall faucet (made of CAC406) having a nominal diameter of 25 mm and an inner volume of 40 ml. The amounts of nickel elution were obtained of a given sample installed at the trailing terminal of a piping and operated as a plumbing utensil for the elution test, with the conditioning test omitted in accordance with the provision of JIS S3200-7 "Method for testing a plumbing utensil for property of elution."

TABLE 13

| | Amount of Ni eluted before acid pickling | | Conditions for acid pickling | | | |
|---|---|---|---|---|---|---|
| Sample No. | Actually measured value A | Corrected value B | Concentration of nitric acid | Concentration of hydrochloric acid | Temperature of treatment | Duration of treatment |
| 1 | 2.40 | 0.096 | 4 wt % | 0.4 wt % | 10° C. | 6 sec |
| 2 | 2.89 | 0.116 | 4 wt % | 0.4 wt % | 10° C. | 20 sec |
| 3 | 4.34 | 0.174 | 4 wt % | 0.4 wt % | 10° C. | 40 sec |
| 4 | 2.92 | 0.117 | 4 wt % | 0.4 wt % | 10° C. | 60 sec |
| 5 | 2.86 | 0.114 | 4 wt % | 0.4 wt % | 10° C. | 600 sec |
| 6 | 2.93 | 0.117 | 4 wt % | 0.4 wt % | 15° C. | 60 sec |
| 7 | 6.42 | 0.257 | 4 wt % | 0.4 wt % | 25° C. | 6 sec |
| 8 | 8.36 | 0.334 | 4 wt % | 0.4 wt % | 25° C. | 20 sec |
| 9 | 7.72 | 0.309 | 4 wt % | 0.4 wt % | 25° C. | 40 sec |
| 10 | 2.94 | 0.118 | 4 wt % | 0.4 wt % | 25° C. | 60 sec |
| 11 | 8.63 | 0.345 | 4 wt % | 0.4 wt % | 25° C. | 600 sec |
| 12 | 5.21 | 0.208 | 4 wt % | 0.4 wt % | 30° C. | 60 sec |
| 13 | 2.97 | 0.119 | 4 wt % | 0.4 wt % | 50° C. | 6 sec |
| 14 | 5.15 | 0.206 | 4 wt % | 0.4 wt % | 50° C. | 20 sec |
| 15 | 6.52 | 0.261 | 4 wt % | 0.4 wt % | 50° C. | 40 sec |
| 16 | 5.38 | 0.215 | 4 wt % | 0.4 wt % | 50° C. | 60 sec |
| 17 | 1.58 | 0.063 | 4 wt % | 0.4 wt % | 50° C. | 600 sec |
| 18 | 2.95 | 0.118 | 0.5 wt % | 0.05 wt % | 25° C. | 60 sec |
| 19 | 6.28 | 0.251 | 7 wt % | 0.7 wt % | 25° C. | 6 sec |
| 20 | 7.36 | 0.294 | 7 wt % | 0.7 wt % | 25° C. | 20 sec |
| 21 | 5.65 | 0.226 | 7 wt % | 0.7 wt % | 25° C. | 60 sec |

| | Amount of Ni eluted after acid pickling | | Amount of Ni removed | Reaction velocity of Ni removal (actually | Pealing | |
|---|---|---|---|---|---|---|
| Sample No. | Actually measured value C | Corrected value D | (corrected value) B − D | measured value) (A − C)/t | of plated surface | Rating |
| 1 | 0.113 | 0.005 | 0.09 | 0.381 | None | ○ |
| 2 | 0.040 | 0.002 | 0.11 | 0.143 | None | ○ |
| 3 | 0.252 | 0.010 | 0.16 | 0.102 | None | ○ |
| 4 | 0.105 | 0.004 | 0.11 | 0.047 | None | ○ |
| 5 | 0.106 | 0.004 | 0.11 | 0.005 | None | ○ |
| 6 | 0.175 | 0.007 | 0.11 | 0.005 | None | ○ |
| 7 | 0.854 | 0.034 | 0.22 | 0.928 | None | X |
| 8 | 0.057 | 0.002 | 0.33 | 0.415 | None | ○ |
| 9 | 0.086 | 0.003 | 0.31 | 0.191 | None | ○ |
| 10 | 0.216 | 0.009 | 0.11 | 0.045 | None | ○ |
| 11 | 0.231 | 0.009 | 0.34 | 0.014 | None | ○ |
| 12 | 0.204 | 0.008 | 0.20 | 0.008 | None | ○ |

TABLE 13-continued

| | | | | | | |
|---|---|---|---|---|---|---|
| 13 | 0.131 | 0.005 | 0.11 | 0.473 | None | ○ |
| 14 | 0.230 | 0.009 | 0.20 | 0.246 | None | ○ |
| 15 | 0.253 | 0.010 | 0.25 | 0.157 | None | ○ |
| 16 | 0.234 | 0.009 | 0.21 | 0.086 | None | ○ |
| 17 | 0.173 | 0.007 | 0.06 | 0.002 | None | ○ |
| 18 | 0.905 | 0.036 | 0.08 | 0.034 | None | X |
| 19 | 0.818 | 0.033 | 0.22 | 0.910 | Presence | X |
| 20 | 0.936 | 0.037 | 0.26 | 0.321 | Presence | X |
| 21 | 0.160 | 0.006 | 0.22 | 0.092 | Presence | X |

Since the nickel on the inner surface of a plumbing device is the deposit of a nickel salt originally contained in the plating fluid, the amount of nickel eluted before the acid-pickling treatment fairly differs among samples as shown in the actually measured values shown in the table.

As regards the temperature of treatment, the prescribed guideline value of nickel elution (0.01 mg/l or 0.02 mg/l) was satisfied at any of the temperatures 10° C., 15° C., 25° C., 30° C., and 50° C. as shown in the samples No. 1 to No. 17. Particularly the treatment at 25° C. (normal room temperature) could satisfy the aforementioned guideline value of nickel elution in spite of the fact that the amount of nickel elution before the acid-pickling was as high as about 6 to 8 mg/1.

As regards the duration of treatment, when the duration of treatment was as short as 6 seconds, the prescribed guideline value of nickel elution could not be satisfied as shown in the sample No. 7.

As regards the concentration of treatment, when the concentration of nitric acid was as low as 0.5 wt %, the prescribed guideline value of nickel elution could not be satisfied as shown in the sample No. 18. In contrast, when the concentration of nitric acid was as high as 7 wt %, though not all the samples satisfied the prescribed guideline value of nickel elution as shown in the samples No. 19 to No. 21, the samples suffered the outer surfaces (plated surfaces) thereof to peel off eventually.

For the purpose of enabling the acid-pickling treatment of this invention to effect a treatment for precluding nickel elution on a plated plumber device, therefore, it is commendable to fix the concentration c of nitric acid in the range of 0.5 wt %<c<7 wt %. When the concentration of hydrochloric acid was lower than 5% based on the concentration of nitric acid, the inhibitor effect of hydrochloric acid decreased and the inner surface (the surface not exposed to the plating action) of the plumbing device was found to suffer from discoloration. Conversely, when the concentration of hydrochloric acid was unduly high, some of the samples were found to have sustained a stress-corrosion cracking.

For the purpose of enabling the acid-pickling treatment of this invention to effect a treatment for precluding nickel elution on a plated plumber device, therefore, it is recommendable to fix the concentration d of hydrochloric acid in the range of 0.05 wt %<d<0.7 wt % in consideration of the fact that the samples No. 18 to No. 21 did not satisfy the prescribed guideline value of nickel elution.

Figure 16:
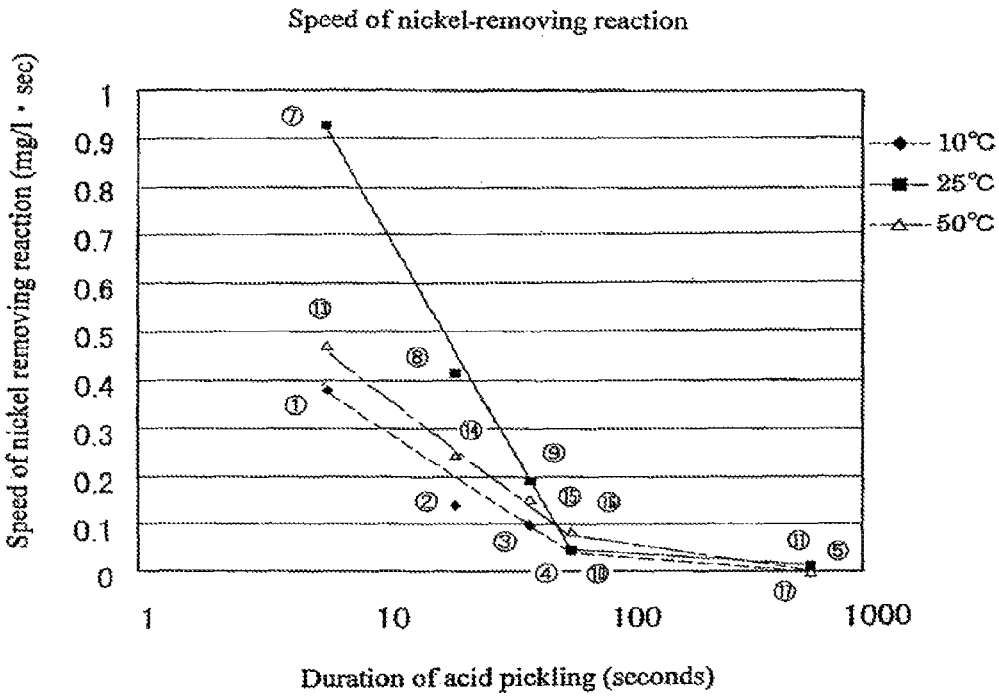
FIG. 16 is a graph showing the velocity of the reaction for the removal of nickel.

The reaction velocity of the nickel removal derived from the results of the samples No. 1 to No. 5, No. 7 to No. 11 and No. 13 to No. 17 shown in Table 13 is shown on a logarithmic graph in FIG. 16.

FIG. 16 clearly indicates that the reaction velocity of nickel removal during the initiation of the acid pickling is highest when the temperature is 25° C. (normal room temperature). The reaction velocity for the cleaning temperature of 50° C. was less than half of the reaction velocity for 25° C. and only slightly higher than that for 10° C. because the air bubbles generated by boiling in the acid-pickling fluid began to gain in prominence when the treating temperature surpassed 50° C., tended to give rise to air pockets in the plumber device under treatment, and imparted portions incapable of contacting the fluid to the surface of the plumbing device.

When the removal of nickel advanced and the duration of acid pickling neared 60 seconds, the reaction velocity reached an approximately equal level at all the temperatures used in the test.

For the purpose of enabling the acid-pickling treatment of this invention to effect a treatment for precluding nickel elution on a plated plumber device, therefore, it is recommendable to set the lower limit of the duration of acid pickling at 20 seconds and preferably at 60 seconds. Further, for the purpose of enabling the acid pickling contemplated by this invention to effect a treatment for precluding elution of lead, it is commendable to set the lower limit of the duration of acid pickling at 10 minutes.

By implementing the acid pickling contemplated by this invention particularly in the range of normal room temperature as described above, it is made possible to perform a nickel-removing treatment capable of satisfying the prescribed guideline value of elution with an addition to the reaction velocity without deteriorating the surface of the plumbing device under treatment. Further, by carrying out the acid-pickling treatment contemplated by this invention, it is made possible to attain satisfactory removal of not merely the nickel adhering to the inner surface of the plumbing device but also the nickel contained in at least the surface layer of the liquid-contacting part of the plumbing device.

Since this invention contemplates giving a plated plumbing device an acid pickling by the use of a mixed acid consisting of nitric acid and hydrochloric acid, it can effect the removal of nickel without suffering the copper alloy part of the device to discolor. The plumbing device that has the casting surface thereof directly plated, does not easily acquire a uniformly plated layer. Even from this plumbing device, the method for precluding nickel elution contemplated by this invention is capable of removing nickel without discoloring the casting surface or impairing the outward appearance of the plated surface. A plumbing device, such as a faucet, that has the casting surface thereof buffed and then plated is capable of easily retaining the plated layer uniformly. From the plumbing device which does not call for much heed to the discoloration of the copper alloy part, the acid pickling using only nitric acid may be used for the removal of nickel.

Though the present embodiment uses hydrochloric acid as an inhibitor, an organic acid, such as acetic acid or sulfamic acid, may be used instead and a mixed acid obtained by mixing this acid with nitric acid may be used for the removal of nickel.

The present embodiment has been described with respect to the application of the method for precluding elution of lead and nickel to the plumbing hardware made of a copper alloy.

The method, however, can be applied to the plumbing hardware made of other metallic material. It can be made to effect a treatment for precluding elution that is aimed at proper removal of both or either of lead and nickel.

C3771 has the drawback of inducing dezincification corrosion. The use of a copper-based alloy developed by the applicant of the subject patent application (JP-A HEI 7-207387) allows provision of a plumbing device possessing the property of resisting deleading and dezincification. This copper-based alloy is a copper-based alloy excelling in corrosion resistance and hot-working property and characterized by having a composition comprising 59.0 to 62.0% of Cu, 0.5 to 4.5% of Pb, 0.05 to 0.25% of P, 0.5 to 2.0% of Sn, 0.05 to 0.30% of Ni and the balance of Zn and unavoidable impurity (by weight %) or a copper-based alloy excelling in corrosion resistance and hot-working property and characterized by having a composition comprising 59.0 to 62.0% of Cu, 0.5 to 4.5% of Pb, 0.05 to 0.25% of P, 0.5 to 2.0% of Sn, 0.05 to 0.30% of Ni, 0.02 to 0.15% of Ti and the balance of Zn and unavoidable impurity (by weight %) and having an "α+β" texture finely divided uniformly.

Further, the use of another copper-based alloy developed by the same patent applicant (JP-B HEI 9-105312) permits provision of a plumber device which possesses hot-working property and the property to resist stress corrosion besides the properties enumerated above. This copper-based alloy is a copper-based alloy characterized by possessing a composition comprising 58.0 to 63.0% of Cu, 0.5 to 4.5% of Pb, 0.05 to 0.25% of P, 0.5 to 3.0% of Sn, 0.05 to 0.30% of Ni and the balance of Zn and unavoidable impurity (by weight %), excelling in corrosion resistance and hot-working property in consequence of uniform fine division of an "α+β" texture, having mechanical properties, such as tensile strength, proof strength and elongation, enhanced by undergoing proper elongation and heat treatment, and having the resistance to stress-corrosion cracking exalted by thorough removal of inner stress or a copper-based alloy characterized by possessing a composition comprising 58.0 to 63.0% of Cu, 0.5 to 4.5% of Pb, 0.05 to 0.25% of P, 0.5 to 3.0% of Sn, 0.05 to 0.30% of Ni, 0.02 to 0.15% of Ti and the balance of Zn and unavoidable impurity (by weight %), excelling in corrosion resistance and hot-working property in consequence of uniform fine division of an "α+β" texture, having mechanical properties, such as tensile strength, proof strength and elongation, enhanced by undergoing proper elongation and heat treatment, and having the resistance to stress-corrosion cracking exalted by thorough removal of inner stress, and further having P and Sn incorporated at such a ratio as satisfies the formula, P (%)×10=(2.8 to 3.98) (%)−Sn (%).

As a means to preclude elution of lead infallibly besides the aforementioned method for precluding elution of lead (method for precluding elution of lead and nickel) according to this invention, a method for precluding elution of lead by performing a treatment of chemical abrasion prior to the acid-pickling step has been known. This method for precluding elution of lead will be described below.

Figure 17:
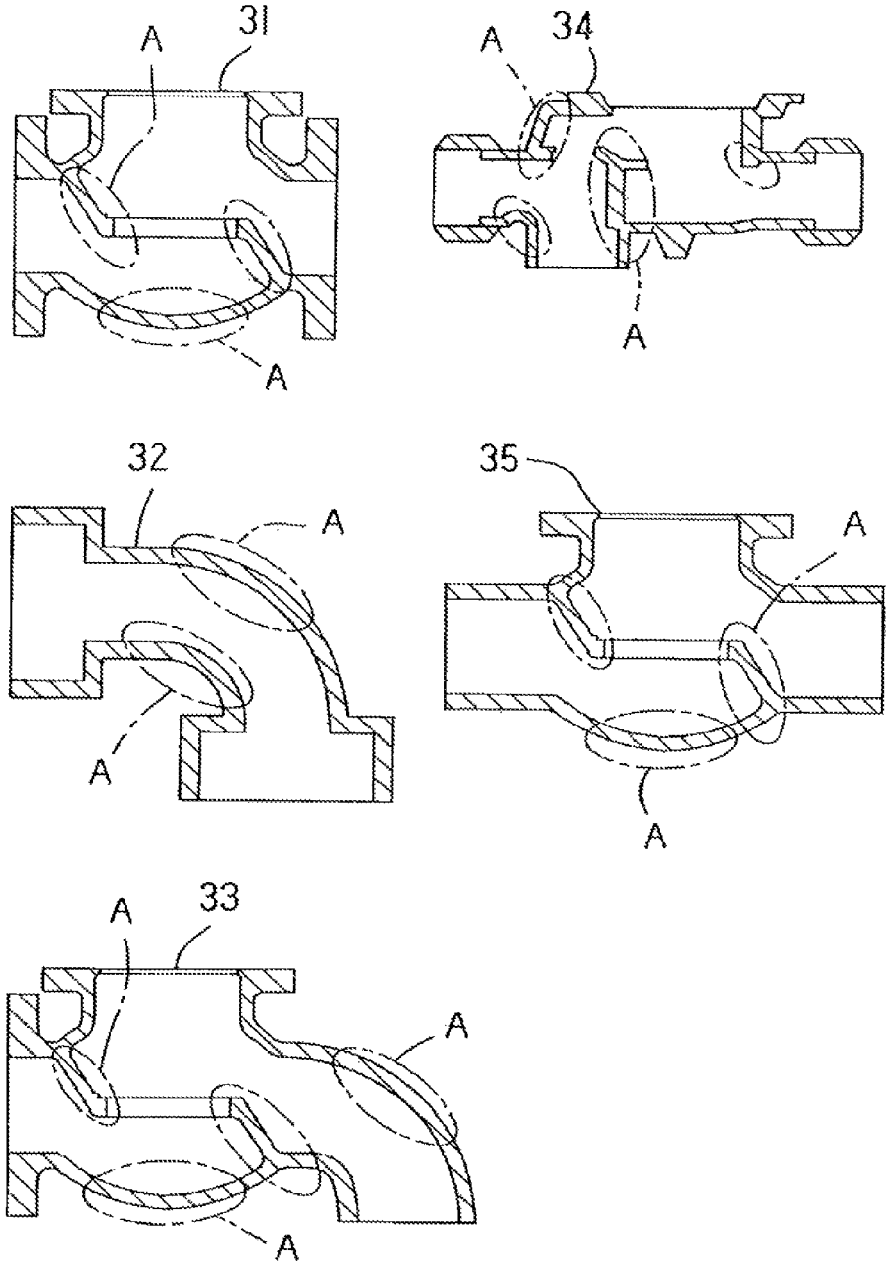
FIG. 17 is a diagram showing the cross sections of varying plumbing devices revealing portions of heavy occurrence of lead segregation.

For example, a globe valve 31, an elbow 32, a combination faucet 33, a decompression valve 34 and a water meter 35 which are illustrated in FIG. 17 have copious presence of lead segregation (existing CAC406 products having lead contents of not less than 30 wt %) in the surface layer of the liquid-contacting part at the position A encircled with an alternate long and short dash line in the diagram.

The reason for the presence of lead in a segregated form in the surface layer is that when the mold is formed of sand, the cooling of the gaps between the adjacent sand grains is locally delayed and the gas emanating from the molten metal is gathered in the gaps and eventually caused to form a solid part and, as a result, the lead which has a low melting point is suffered to crystallize. Since the casting surface forms countless undulations with sand grains, it is eventually suffered that the lead is segregated on the casting surface.

Among other various surfaces of the plumbing device, particularly the interior of the flow path that has a complicated shape causes the aforementioned gas to stagnate therein for a long time as compared with the other places and consequently induces the lead of a low melting point to crystallize very copiously.

The plumbing hardware that is made of a copper alloy containing lead as described above is particularly suitable for a plumbing device made of a copper alloy and possessed of a flow path of a complicated shape. By subjecting this plumbing device to a chemical polishing treatment capable of removing by abrasion the surface layer of the liquid-contacting part on the inner surface of a body part having a large lead content to the same level as the machined surface, removing by abrasion the lead existing in a segregated state in the surface layer of the liquid-contacting part, and then performing thereon an acid-pickling treatment or an alkali-pickling treatment, thereby effectively removing the lead still remaining in the surface layer of the liquid-contacting part, the plumbing device is enabled to satisfy infallibly the standard of water quality with respect to lead elution. The acid-pickling treatment is adopted when nickel is removed by solution together with lead.

FIG. 18 is a process explanatory diagram showing one example of this method for removal of lead by solution. This example will be described on the assumption that an acid-pickling treatment is adopted for the cleaning step.

First, the chemical polishing step will be explained.

The valve having a valve seal part thereof so constructed as to be sealed with a metallic touch is subjected to the chemical polishing treatment after the step of casting as illustrated in FIG. 18 because the chemical polishing treatment, when performed after the machining step, deprives the seat surface of its roughness to an extent of degrading the sealing property.

The valve having an elbow and a valve seat part thereof constructed so that they are sealed with a soft seat is subjected to the chemical polishing treatment after the machining step. Thus, the process efficiency is exalted because the process is divided into a mechanical treatment represented by machining and a chemical treatment starting from a chemical polishing treatment.

The faucet, the decompression valve and the water meter are subjected to the chemical polishing treatment after the casting step when the valve seal part is constructed so that it is sealed in metallic touch. They are subjected to the chemical polishing treatment after the machining step when the valve seat part is constructed so that it is sealed with a soft seat.

In this example, the surface layer of the liquid-contacting part of the aforementioned plumbing device made of a copper alloy (hereinafter referred to as a plumbing device) is subjected to a chemical polishing treatment (duration of treatment: not less than 10 seconds) using a chemical polishing fluid consisting of nitric acid, sulfuric acid and hydrochloric acid and then to an acid pickling treatment or an alkali-pickling treatment so that the eluted lead may be removed by abrasion to the level of satisfying the standard of water quality with respect to lead elution. To be specific, this removal by polishing is effected till the level not surpassing 26 wt % at most.

One example of the chemical polishing treatment to be performed in this case is shown in Table 14.

It is for the purpose of simultaneously and equally removing by abrasion elements, such as copper, tin, zinc and lead, which are chemical components of a copper alloy that various types of treatment are offered for proper selection. These treatments may be properly selected so as to suit a varying chemical composition of the copper alloy. The chemical polishing treatments of type 1 and type 5 are particularly suitable for the plumbing device made of a copper alloy to which the method of precluding lead elution of the present example is applied. The chemical polishing treatment does not need to be limited to the examples shown in Table 14.

TABLE 14

| Type 1 | | Type 2 | |
|---|---|---|---|
| Nitric acid | 200 ml/l | Nitric acid | 20 to 80 vol. |
| Saturated acid | 400 ml/l | Sulfuric acid | 20 to 80 vol. |
| Hydrochloric acid | 2 ml/l | Hydrochloric acid | 0.1 to 10 vol. |
| | | Chromic acid | 5 to 200 vol. |
| Water | 300 ml/l | Water | Used optionally |
| Temperature: | Normal Temp. | Temperature: | Normal Temp. |
| **Type 3** | | **Type 4** | |
| Phosphoric acid | 30 to 80% (vol.) | Phosphoric acid | 550 ml |
| Nitric acid | 5 to 20% (vol.) | Nitric acid | 200 ml |
| Glacial acetic acid | 10 to 50% (vol.) | Glacial acetic acid | 50 ml |
| | | Hydrochloric acid | 5 ml |
| Water | 0 to 10% (vol.) | | |
| Temperature | 50 to 80° C. | Temperature | 55 to 80° C. |
| **Type 5** | | **Type 6** | |
| Phosphoric acid | 40 ml | Chromic acid | 450 g/l |
| Nitric acid | 15 ml | Sulfuric acid | 125 ml/l |
| Water | 48 ml | Hydrochloric acid | 5 ml/l |

TABLE 14-continued

| | | | |
|---|---|---|---|
| Hydrochloric acid | 1.5 ml | | |
| Ammonium nitrate | 90 g | Glacial acetic acid | 75 ml/l |
| Temperature | 35° C. | Temperature | 45° C. |
| **Type 7** | | **Type 8** | |
| Phosphoric acid | 45 to 60% (vol.) | Sodium bichromate | 70 to 120 g/l |
| Nitric acid | 8 to 15% (vol.) | | |
| Sulfuric acid | 15 to 25% (vol.) | Sulfuric acid | 100 to 200 ml/l |

TABLE 14-continued

| | | | |
|---|---|---|---|
| Water | 10 to 20% (vol.) | Benzotriazole | 2 to 40 g/l |
| Temperature | not less than 65° C. | Temperature | 40 to 50° C. |
| **Type 9** | | **Type 10** | |
| Hydrogen peroxide | 100 M/l | Nitric acid | 40 ml |
| | | Cuprous chloride | 3 g |
| Sulfuric acid (or hydrofluoric acid & nitric acid) | 2 M/l | Glacial acetic acid | 60 ml |
| | | Potassium bichromate | 6 g |
| Saturated alcohol | small amount | | |
| | | Temperature | 20 to 50° C. |
| Temperature | 50° C. | | |

As other means of abrasion, a sand blast treatment that consists in blasting a metal surface with a high-speed jet of metal particles and a mechanical abrasion that resorts to a high-pressure cleaning with water or air are available. These methods perfectly remove the surface layer of the liquid-contacting part having a high lead content till a lead content in the range of 4 to 6 wt % of lead specified in JIS H5120. The mechanical abrasion has such a strong removing force as to remove completely not only the inner surface of a body part but also the projected part and the cast letters on the casting surface and, therefore, is unsuitable as a means to polish. Thus, the chemical polishing treatment that is capable of effectively removing by a cleaning action the lead.

The lead content (wt %) of the surface layer of the liquid-contacting part that had undergone the chemical polishing treatment of this example and the lead content (wt %) of the surface layer of the liquid-contacting part that had undergone a mechanical polishing treatment are shown in Table 15.

TABLE 15

| Method of abrasion | | | | Object for test | Site of test | Lead wt % |
|---|---|---|---|---|---|---|
| Untreated product | | | | Globe valve, JIS B2011 | Bottom | 30~35 |
| Removal of surface layer, 0.5 mm, by cutting | | | | Globe valve, JIS B2011 | Bottom | 5 |
| Method for removal by abrasion | Removal by mechanical abrasion | Shot blasting treatment, 30 minutes | | Globe valve, JIS B2011 | Bottom | 29 |
| | | Sand blasting treatment | | Globe valve, JIS B2011 | Bottom | 4 |
| | | High-pressure cleaning with water | 28 MPa | Globe valve, JIS B2011 | Bottom | 25 |
| | | | 20 MPa | Globe valve, JIS B2011 | Bottom | 18 |
| | | | 10 MPa | Globe valve, JIS B2011 | Bottom | 20 |
| | | High-pressure cleaning with air | 28 MPa | Globe valve, JIS B2011 | Bottom | 22 |
| | Removal by chemical abrasion (Kirins treatment) | | | Globe valve, JIS B2011 | Bottom | 17 |

Here, the difference between the known chemical polishing treatment and the chemical polishing treatment of the present example will be explained.

The chemical polishing is intrinsically aimed at activating a metal surface by removing a scale and stripping the surface layer of an oxide coat prior to an arbitrary plating treatment. For the sake of comparison, the method for determining the amount of lead eluted (mg/l) when the cleaning treatment (the acid-pickling treatment in the present example) was carried out after the known chemical abrasion and the results of determination are shown in Table 16.

TABLE 16

| Step | Conditions of treatment | Duration of treatment |
|---|---|---|
| Chemical polishing step | Type 1 | 4 sec. |
| Cold water washing step | Normal temperature | 1 min-shaking |
| Cleaning step | Normal temperature 4 wt % of nitric acid and 0.4 wt % of hydrochloric acid | 10 min immersion |
| Cold water washing step | Normal temperature | 10 min immersion |
| Rust preventing step | Normal temperature | 30 sec. Immersion |
| Results of elution test | JIS B2011 bronze valve 10K, screw type glove valve having a nominal diameter of 1/2 | 0.3 mg/l (corrected value) |

The term "normal room temperature" as used herein refers to 20° C. and the term "corrected value" refers to the results of correction adapted to the "device inserted halfway in the length of a piping" specified by JIS S3200-7.

Thus, by the popular chemical polishing treatment that has a different object of treatment from the method for precluding lead elution of this invention, the surface layer of the liquid-contacting part having a high lead content could scarcely be removed.

Figure 19:
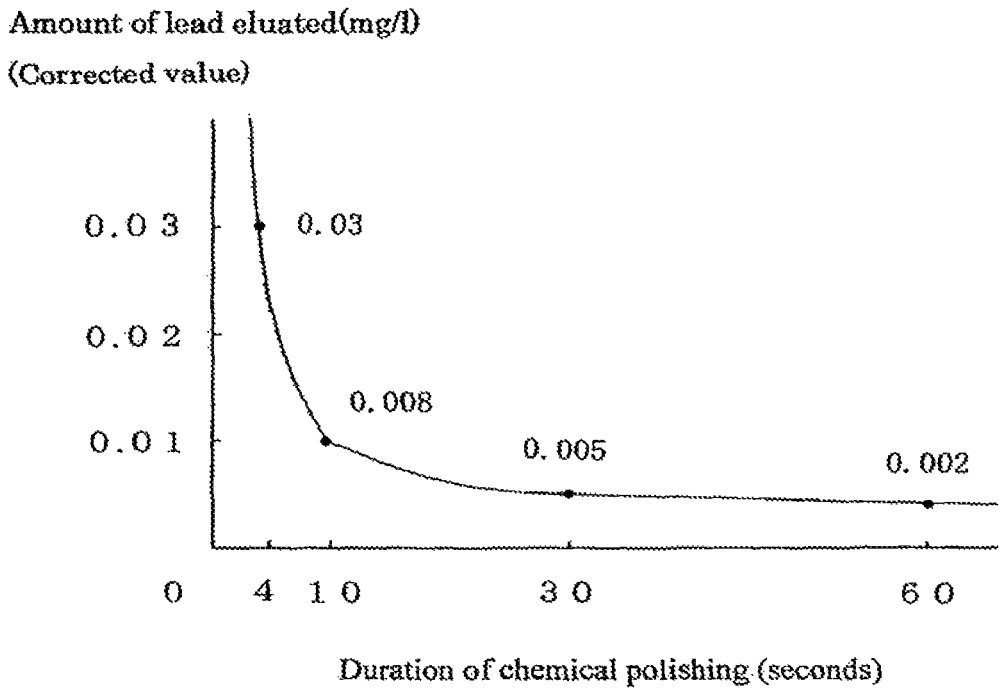
FIG. 19 is a graph showing the relation between the duration of a treatment of chemical abrasion and the amount of lead elution.

Thus, the present inventors have explored chemical polishing conditions under which lead can be effectively ground and removed by a cleaning treatment, consequently taken notice of the relation between the duration of the chemical polishing treatment and the amount of lead eluted, and found that the satisfaction of the lead elution of not more than 0.01 mg/l requires the chemical polishing treatment to be performed for a duration of not less than 10 seconds as shown in FIG. 19. In order to effect this removal of lead more stably with an appreciable allowance for the fluctuation of the segregation of lead on the surface under treatment, the duration of the treatment is preferred to be approximately 20 seconds. If the duration of this treatment is unduly elongated, the overage will bring no proportionate addition to the effect of lead removal but will rather result in coarsening the surface under treatment. Thus, the upper limit of the duration of this treatment is 30 seconds.

The chemical polishing treatment continues to generate a large volume of heat of reaction during the course of the treatment and instantaneously vaporizes the film of cutting oil adhering to the surface. When the valve seat part which is subjected to the chemical polishing treatment after the machining step as shown in FIG. 18 is so constructed as to be sealed with a soft sheet, it has no need for the degreasing step.

After the chemical polishing treatment, the chemical polishing fluid adhering to the treated surface is thoroughly washed away at the cold water-washing step (normal room temperature).

Now, the acid-pickling step will be described.

The plumbing device mentioned above is immersed in the treating tank that holds an acid-containing cleaning fluid to induce effective removal of the lead remaining on the surface layer of the liquid-contacting part. In this case, the corrosion of lead in the treating tank holding the cleaning fluid may be promoted by subjecting the cleaning fluid to ultrasonic oscillation or a swirling motion. When the acid pickling of a prescribed duration terminates, the plumbing device is extracted from the cleaning fluid.

Here, the action produced by the supersonic oscillation or the swirling motion in promoting the elution of lead from the plumbing device will be described. The ultrasonic washing which is implemented by exposing a given plumbing device to the supersonic waves in the cleaning fluid is effective in quickly removing from the surface of the plumbing device various lead compounds by reactions in the cleaning fluid and the swirling motion which is implemented by shaking the plumbing device itself in the cleaning fluid is effective in removing the lead compounds from the plumbing device or eliminating the air pools produced in the immersed product. Particularly by exalting the agitation of the cleaning fluid enveloping the plumbing device, the cleaning fluid forms lead compounds and renders the lead readily soluble. It is commendable to use the supersonic oscillation and the swirling motion in combination.

As the cleaning fluid mentioned above, a mixture resulting from combining an acid, such as nitric acid or acetic acid, which corrodes lead with tap water or purified water and a mixture resulting from combining a mixed gas comprising nitric acid and hydrochloric acid having an inhibitor effect with tap water or purified water may be used.

In this case, since the $Cl^-$ ions of hydrochloric acid corrode the copper surface while uniformly forming a film thereon, the copper surface retains glossiness during the process of corrosion. At this time, the corrosion is allowed to last because lead hydrochloride and lead nitrate are formed in the lead part of the copper surface and these lead salts are both soluble in the mixed acid.

Next, the acid contained in the cleaning fluid mentioned above will be described.

Generally, it is known that an acid corrodes (oxidizes) lead. Lead, however, does not easily allow continuous corrosion because it tends to form an oxide film by the reaction with an acid. Nitric acid, hydrochloric acid and organic acids, such as acetic acid, however, continuously corrode lead. Among other acids enumerated above, nitric acid ($HNO_3$) particularly manifests the highest velocity of corrosion.

Hydrochloric acid (HCl), though revealing a low lead-corroding velocity as compared with nitric acid, possesses a large combining force with copper. When the mixed acid resulting from mixing this acid with nitric acid is used for acid-pickling lead, the mixed acid forms a copper chloride (CuCl) film on the surface of a plumbing device and consequently manifests the so-called inhibitor effect of suppressing the corrosion of copper with nitric acid before the nitric acid and copper undergo a chemical reaction and form copper oxide ($Cu_2O$ or CuO).

When an acid, such as nitric acid, that corrodes lead as described above is used alone, benzotriazole (BTA) may be incorporated in the place of hydrochloric acid as an inhibitor. Benzotriazole is a chelating reagent particularly for copper and silver that exist in a monovalent state and is used for the purpose of suppressing discoloration and corrosion of these metals.

When acetic acid is used for corroding lead, no incorporation of an inhibitor is required because acetic acid does not undergo a chemical reaction with copper. The acid-pickling treatment does not need to be limited to the present example.

After the acid-pickling step, the plumbing device is washed in the cold water-washing step to expel thoroughly the cleaning fluid adhering thereto.

By carrying out the cold water washing for about 10 minutes as in the present case, it is made possible to attain thorough removal of the hydrochloric acid adhering to the metal surface as an inhibitor and prevent the acid-pickled surface of the plumbing device from discoloration.

Further, by giving thorough air blow to the plumbing device during the rust-preventing treatment subsequent to the cold water-washing step, it is made possible to attain thorough prevention of the surface of the plumbing device from discoloration.

If the surface should be discolored, the discoloration will be eliminated through removing the oxide film from the surface of the plumbing device using a sulfur-based degreasing agent (Gildaon NP-100, a product of Chuokagaku Corporation, etc.) and then repeating the cold water-washing step and the rust-preventing step once more.

On a plumbing device that has not undergone a plating treatment, the chemical polishing imparts a remarkable gloss or dimness to the surface thereof. After the surface treatment (FIG. 18), therefore, the plumbing device may be subjected to a nickel chromium-plating treatment. When the plating treatment is given to the plumbing device immediately after the acid-pickling step, the rust-preventing step may be omitted.

Now, a concrete example of using the chemical polishing treatment on a JIS B2011 10K globe valve made of bronze will be described below.

A JIS B2011 10K globe valve which had been cast and machined was immersed for 10 seconds in a treating tank containing a chemical polishing fluid (normal room temperature) of Type 1 of Table 14, having a composition of 200 ml/1 of nitric acid, 400 ml/1 of sulfuric acid, 2 ml/1 of hydrochloric acid and 300 ml/1 of water to implement a chemical polishing treatment for removing by abrasion the lead occurring as segregated on the surface layer of the liquid-contacting part.

Figure 20:
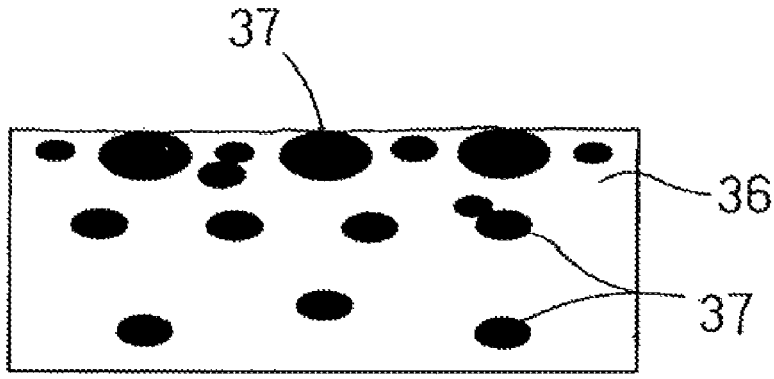
FIG. 20 is a schematic view illustrating the distribution of lead in the surface layer of the liquid-contacting part of the inner surface of the body of a globe valve (untreated product) made of bronze in accordance with JIS B2011 10K.
Figure 21:
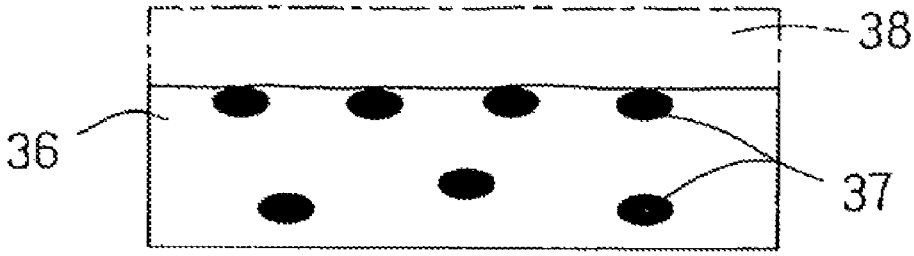
FIG. 21 is a schematic view illustrating the distribution of lead in the surface layer of the liquid-contacting part of the inner surface of the body of a globe valve made of bronze in accordance with JIS B23011 10K subsequent to a treatment of chemical abrasion.

FIG. 20 illustrates distribution of lead 37 in a surface layer 36 of the liquid-contacting part of the inner surface of the body of the JIS B2011 10K globe valve prior to the chemical polishing treatment, as observed with an EPMA (X ray microanalyzer) and depicted in a schematic view and FIG. 21 is a schematic view subsequent to the chemical polishing treatment. In the diagrams, numeral 38 denotes parts of the surface layer 36 of the liquid-contacting part removed by polishing.

After the chemical polishing treatment, the globe valve was treated in the cold water-washing step (normal room temperature) to expel the adhering chemical polishing fluid. After the cold water-washing step, it was given a cleaning treatment (the acid-pickling treatment in the present case) in the cleaning step.

In the cleaning step of the present case, the globe valve was immersed for 10 minutes in a cleaning tank holding a cleaning fluid containing 4 wt % of nitric acid+0.4 wt % of hydrochloric acid to implement a cleaning treatment (acid-pickling treatment) and induce effective removal of the residual lead on the surface layer of the liquid-contacting part.

After undergoing the cleaning step and then the old water-washing step (normal room temperature), the globe valve was subjected to a nickel chromium-plating treatment in the plating step. During the immersion in the varying treating tank, the treating fluid preferably may be swirled to ensure thorough removal of air bubbles still remaining in a small amount on the globe valve.

Figure 22:
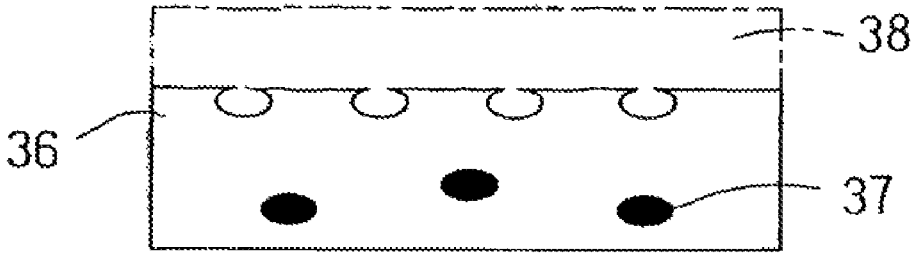
FIG. 22 is a schematic view illustrating the distribution of lead in the surface layer of the liquid-contacting part of the inner surface of the body of a globe valve made of bronze in accordance with JIS B23011 10K subsequent to the performance of a method for precluding lead elution by a treatment of chemical abrasion.

FIG. 22 illustrates distribution of lead 37 in a surface layer 36 of the liquid-contacting part of the inner surface of the body of a JIS B2011 10K globe valve having undergone a method for precluding lead elution, as observed with an EPMA (X ray microanalyzer) and depicted in a schematic view.

The JIS B2011 20K globe valve that had undergone the method of precluding lead elution was analyzed to determine the amount of lead elution (mg/l). The results of the analysis are shown in Table 17.

As shown in Table 17, the present example succeeded in realizing a minute lead elution, such as of 0.008 mg/l.

Here, the term "normal room temperature" means 20° C. and the term "corrected value" means the result of correction made in conformity with the value of "the device in the piping" specified in JIS S3200-7.

TABLE 17

| Step | Conditions for performance | Duration of treatment |
|---|---|---|
| Chemical polishing step | Type 1 | 10 min |
| Cold water washing step | Normal temperature | One min-shaking |
| Cleaning step | Normal temperature 4 wt % of nitric acid and 0.4 wt % of hydrochloric acid | 10 min immersion |
| Cold water washing step | Normal temperature | 10 min immersion |
| Plating step | Nickel chromium plating | |
| Results of elution test | JIS B2011 bronze valve 10K, screwed type glove valve having a nominal diameter of 1/2 | 0.008 mg/l (corrected value) |

Next, the adoption of an alkali-pickling treatment for the cleaning step mentioned above will be described.

The valve having the valve seat part thereof constructed so that the part is sealed with metallic touch is subjected to a chemical polishing treatment after the casting step because the chemical polishing treatment, when performed after the machining step, deprives the seat surface of roughness and eventually degrade the sealing ability of the valve.

Then the valve having an elbow and a valve seat part thereof constructed so that they are sealed with a soft sheet, when subjected to a chemical polishing treatment after the machining step, enjoys an exalted working efficiency because it permits division between a machining treatment represented by working and chemical treatments including and following a chemical polishing treatment.

Thus, a faucet, a decompression valve and a water meter having valve seat parts thereof so that the parts are sealed with a metallic touch are subjected to a chemical polishing treatment after the casting step. Those that have valve seat parts thereof constructed so that the parts are sealed with a soft seat are subjected to the chemical polishing treatment after the machining step.

The chemical polishing treatment may be properly selected from the various types shown in Table 14 so as to suit the chemical composition of the copper alloy of the particular plumbing device subjected to the treatment. The surface layer of the liquid-contacting part of a plumbing device made of a copper alloy (hereinafter referred to as "plumbing device") is subjected to the chemical polishing treatment (duration of treatment not less than 10 seconds) to effect removal of eluted lead by the polishing. After this chemical polishing treatment, the plumbing device is washed in the cold water-washing step (normal room temperature) to expel the adhering chemical polishing fluid. It is then given a cleaning treatment in the alkali-picking step.

Next, the alkali-pickling step will be described.

The plumbing device mentioned above is immersed in a treating tank that holds an alkaline etching fluid incorporating an oxidizing agent therein to induce effective removal of the lead still remaining in the surface layer of the liquid-contacting part thereof.

The main component of the alkaline etching fluid is an alkaline solution of one or more salts selected from the group consisting of sodium hydroxide, potassium hydroxide, sodium carbonate, sodium phosphate, sodium tripolyphosphate, sodium metasilicate, and sodium orthosilicate.

As the oxidizing agent, an organic oxidizing compound, such as sodium metanitrobenzene sulfonate or sodium paranitrobenzoate or an inorganic compound, such as hypochlorite, bleaching powder, hydrogen peroxide, potassium permanganate, persulfate or perchlorate may be used.

The alkali-pickling step exhibits a poor solving property and tends to produce sediment because the eluted lead is in the form of plumbite ions ($PbO_2^{2-}$). The oil component that continues to be solved in the alkaline fluid is gradually decomposed by means of the NaOH in the alkaline fluid into an aliphatic acid and an aliphatic alcohol. The aliphatic alcohol is not dissolved at all in the alkaline fluid and the aliphatic acid, after accumulating past a prescribed amount, begins to resist solution in the alkaline fluid and forms a buoyant substance and defiles the alkaline fluid. The buoyant substance is liable to adhere to the surface of the plumbing device made of a copper alloy. Preferably, therefore, the etching fluid mentioned above is enabled by incorporating therein a chelating agent to form a water-soluble complex and effect removal of lead while preventing adhesion of the sediment.

The component steps that follow this alkali-pickling step will be omitted from the following description because they have been described in detail above by citing an acid-pickling treatment for the cleaning step. The alkali-pickling treatment does not need to be limited to the present example.

The cleaning treatment that is carried out after the chemical polishing treatment may be fulfilled by an acid-pickling treatment or an alkali-pickling treatment as described above.

The alkali-pickling treatment, however, exhibits a poor solution-forming property to the pickling fluid and possesses a low ability to remove lead because it elutes lead in the form of plumbite ions ($PbO_2^{2-}$). It further suffers adhesion of the sedimented lead to the surface of the plumbing device and necessitates frequent filtration and replacement of the pickling fluid.

In contrast, the acid-pickling treatment exhibits an excellent solution-forming property to the pickling fluid, retains the lead-removing ability for a long time and avoids adhesion of the sedimented lead to the alloy because it elutes lead in the form of lead ions ($Pb^{2+}$). It is further capable of preventing the surface of the plumbing device from discoloration. Thus, the combination with the acid-pickling treatment proves advantageous.

The acid-pickling treatment and the alkali-picking treatment do not need to be limited to the examples cited above. Other various pickling treatments may be adopted. The method for precluding lead elution can be applied to varying plumbing devices made of brass.

INDUSTRIAL APPLICABILITY

This invention, in the use of a plumbing device made of a lead-containing metal, vastly decreases the amount of lead eluted as compared with the tolerance based on the conventional standard and, in the use of a plumbing device having a nickel-plated surface, precludes elution of lead by infallibly removing the nickel adhering to the inner surface of the plumbing device. It also permits an efficient (temperature of treatment and duration of treatment) treatment for precluding elution of both or either of lead and nickel and further allows a treatment for neutralizing a varying fluid used in the treatment for precluding elution and enabling the product of neutralization to be utilized as an industrial water, thereby permitting a generous cut of cost and contributing to the protection of the environment against adverse effects of the elution of lead.

The treating fluid contemplated by this invention can be used for giving a cleaning treatment to at least the liquid-contacting part of all conceivable plumbing devices made of copper alloys containing both or either of lead and nickel and consequently inducing efficient removal of both or either of lead and nickel from it.

The invention claimed is:

1. A treatment method for reducing elution of lead from a cast and unprocessed plumbing device that is made of a copper alloy, wherein the plumbing device comprises lead and has a casting surface that is a surface layer of a liquid-contacting part including a valve and a tube coupling, wherein the method comprises subjecting the casting surface that is the surface layer of the liquid-contacting part to a chemical polishing treatment, thereby removing lead existing as segregated on the surface layer of the liquid-contacting part, wherein the chemical polishing treatment is performed for 10 to 30 seconds, thus resulting in lead elution of not more than 0.01 mg/l.

2. The treatment method according to claim 1, further comprising subjecting the surface layer having the lead removed to acid-pickling or alkali-pickling treatment to effectively delead the surface layer.

3. The treatment method according to claim 1, further comprising subjecting the surface layer having the lead removed to acid-pickling or alkali-pickling treatment to effectively delead the surface layer, and subjecting the deleaded surface layer to plating treatment for lead elution reduction.

4. The treatment method according to claim 1, wherein the plumbing device is a valve having a structure having a valve seat part sealed in metal touch, and wherein the method further comprises casting the valve before the chemical polishing treatment and subjecting the valve to surface roughness-increasing treatment after the chemical polishing treatment.

5. The treatment method according to claim 1, wherein the plumbing device is made of bronze or brass.

* * * * *